US008863811B2

(12) United States Patent
Yates et al.

(10) Patent No.: US 8,863,811 B2
(45) Date of Patent: Oct. 21, 2014

(54) ADJUSTABLE WIDTH BARRIER

(75) Inventors: Adam John Yates, Newcastle Upon Tyne (GB); Steven B. Dunn, Beverly Hills, CA (US); Mark A. Hatherill, Beverly Hills, CA (US); Rodolfo Gastelum, San Pedro, CA (US); Thomas Birkert, West Hills, CA (US)

(73) Assignee: Munchkin, Inc., Van Nuys, CA (US)

( * ) Notice: Subject to any disclaimer, the term of this patent is extended or adjusted under 35 U.S.C. 154(b) by 66 days.

(21) Appl. No.: 13/107,162

(22) Filed: May 13, 2011

(65) Prior Publication Data

US 2012/0285099 A1 Nov. 15, 2012

(51) Int. Cl.

| | |
|---|---|
| ***E06B 3/92*** | (2006.01) |
| ***E06B 9/06*** | (2006.01) |
| *E06B 3/70* | (2006.01) |
| *E06B 9/00* | (2006.01) |

(52) U.S. Cl.

CPC ..... *E06B 9/0623* (2013.01); *E06B 9/0661* (2013.01); *E06B 2003/7096* (2013.01); *E06B 2009/002* (2013.01)

USPC ..... 160/136

(58) Field of Classification Search

USPC ..... 160/136, 180, 222, 211, 216, 159, 160

See application file for complete search history.

(56) References Cited

U.S. PATENT DOCUMENTS

| | | | | |
|---|---|---|---|---|
| 1,618,447 | A | 2/1927 | Kusterle | |
| 3,885,616 | A * | 5/1975 | Berkowitz | 160/215 |
| 4,669,521 | A * | 6/1987 | Barnes et al. | 160/136 |
| 5,199,753 | A | 4/1993 | Presley, Jr. | |
| 5,657,809 | A * | 8/1997 | Longoria et al. | 160/369 |
| 5,690,317 | A | 11/1997 | Sandsborg | |
| 5,829,505 | A * | 11/1998 | Brescia | 160/225 |
| 6,112,461 | A * | 9/2000 | Cheng | 49/55 |
| 6,536,502 | B2 * | 3/2003 | Britto et al. | 160/23.1 |
| 6,880,674 | B1 | 4/2005 | St. Hilaire | |
| 7,178,792 | B2 * | 2/2007 | Monahan et al. | 256/73 |
| 7,874,103 | B2 * | 1/2011 | Yates | 49/57 |
| 8,205,388 | B2 * | 6/2012 | Yates | 49/394 |
| 2006/0103142 | A1 * | 5/2006 | Talpe | 292/164 |

(Continued)

FOREIGN PATENT DOCUMENTS

| | | |
|---|---|---|
| GB | 189911914 | 4/1900 |
| GB | 2447655 | 9/2008 |

(Continued)

OTHER PUBLICATIONS

Child Safety "Auto Latch" http://www.afsco-fence.com/site/product.cfm?id=A9031727-1422-201A-555EAB68B1817F43; date of original publication unknown, publication prior to Nov. 5, 2010. 3pages.

(Continued)

*Primary Examiner* — Katherine Mitchell
*Assistant Examiner* — Scott Denion
(74) *Attorney, Agent, or Firm* — Robert Z. Evora, Esq.; Wade C. Yamazaki

(57) ABSTRACT

A gate has an expandable barrier and a horizontal rail located at a top of the barrier. A post may be coupled to the barrier and may have a portion extending above the horizontal rail. A lock is movably coupled to the post above the rail to provide for the locking and unlocking of the gate.

29 Claims, 31 Drawing Sheets

(56) References Cited

U.S. PATENT DOCUMENTS

| | | | | |
|---|---|---|---|---|
| 2008/0087053 | A1 | 4/2008 | Frazier et al. | |
| 2008/0191497 | A1* | 8/2008 | Mayo et al. | 292/169 |
| 2009/0013604 | A1* | 1/2009 | Yates | 49/49 |
| 2009/0064595 | A1* | 3/2009 | Yates | 49/506 |
| 2009/0267356 | A1 | 10/2009 | Van Hellemont | |
| 2012/0055092 | A1* | 3/2012 | Boucquey et al. | 49/192 |

FOREIGN PATENT DOCUMENTS

| | | |
|---|---|---|
| JP | 4094393 | 3/1992 |
| WO | 9305262 | 3/1993 |
| WO | 9400664 | 1/1994 |
| WO | 2008020195 | 2/2008 |

OTHER PUBLICATIONS

Child Safety Adhesive Cabinet Lock; http://www.amazon.com/Child-Safety-Adhesive-Cabinet-2-Pack/dp/B0014REJGO/ref=sr_1_3?ie=UTF8&s=home-garden&qid=1288875141&sr=1-3;date of original publication unknown, publication prior to Nov. 5, 2010. 8pages.

Child Safety Spring Latches URL:http://www.amazon.com/Child-Safety-Spring-Latches-Pack/dp/B0014RG5LQ/ref=sr_1_9?ie=UTF8&s=home-garden&qid=1288875141&sr=1-9; date of original publication unknown, publication prior to Nov. 5, 2010. 6pages.

KidCo 4 Lock Set; URL: http://www.amazon.com/KidCo-KID-3364-4-Lock-Set/dp/B000JOOGK2/ref=pd_sim_k_5; date of original publication unknown, publication prior to Nov. 5, 2010. 12pages.

Safe Lok Cabinet and Drawer Locks (6 pack) with Temporary Disable Feature by Mommy's Helper URL http://www.babyreviewcenter.com/products/productdetails.php?id=B0015GKHK6&browsenode=166865011; date of publication unknown, publication prior to Nov. 5, 2010. 3pages.

Child Safety Latches; URL: http://www.amazon.com/Organize-com-Child-Safety-Latches-Pack/dp/B0014RB1Z6/ref=pd_sim_ba_6; date of original publication unknown, publication prior to Nov. 5, 2010. 9pages.

* cited by examiner

ADJUSTABLE WIDTH BARRIER

FIELD

The present invention generally relates to barrier devices, and in particular to an adjustable width barrier.

BACKGROUND

Falls are a leading cause of injuries to children and toddlers in the home. Safety gates can be used around the home to prevent children from entry into a staircase region or keep the children in a safe area in the home where they can be watched by a caregiver. Additionally, safety gates can be used to prevent movement of small household pets into unwanted spaces or rooms.

BRIEF SUMMARY

Aspects of the present invention pertain to a barrier, such as an adjustable width barrier.

According to one aspect, there is provided a gate including an expandable barrier that has a top horizontal edge. The gate includes a lock control member biased upwardly and located above the top horizontal edge of the expandable barrier for controlling at least one of locking and unlocking of the gate.

According to one aspect, there is provided a gate including an expandable barrier having a top horizontal edge and a vertical rail. A gate-lock is telescopically coupled to the vertical rail for relative movement to control at least one of locking and unlocking of the gate such that the gate-lock is movable between locked and unlocked positions above the top horizontal edge.

According to one aspect, there is provided a gate including an expandable barrier and an adjustable length horizontal rail disposed at a top of the barrier. A post may be coupled to the barrier. A handle-lock module may be coupled to the post above the horizontal rail such that the handle-lock module is movable to provide for the locking or unlocking of the gate.

According to one aspect, there is provided a gate including an expandable barrier having a first vertical end and a second vertical end. A downwardly extending docking pin is disposed at the first vertical end of the barrier; and an upwardly extending locking pin is disposed at the first vertical end of the barrier. The upwardly extending locking pin is located above and coaxial with the downwardly extending docking pin such that the locking pin is biased away from the docking pin to maintain the gate in a locked state.

BRIEF DESCRIPTION OF THE DRAWINGS

The foregoing summary as well as the following detailed description, considered in conjunction with the accompanying drawings, provide a better understanding, in which like reference numbers refer to like elements, and wherein.

DETAILED DESCRIPTION

FIGS. 1A-18 illustrate constructions of an adjustable width barrier system or gate system, including a gate 100 operable to mechanically cooperate with wall mounts 200, 202, 204 to prevent movement of an object (such as, but not limited to, a child or a pet for example) through a passageway/walkway opening. In use, the gate 100 is expandable from a first (retracted) position on one side of a passageway opening across the width of the passageway to a second (expanded) position. Once expanded, the gate 100 can be adjusted from an unlocked state to a locked state to securely lock the gate 100 in the passageway and prevent ingress and egress through the passageway for children and small pets. To open the gate 100 in the passageway, the gate 100 can be adjusted from the locked state to the unlocked state, and then subsequently retracted into the retracted position and pivoted to enable unhindered passage through the passageway opening.

Figure 3:
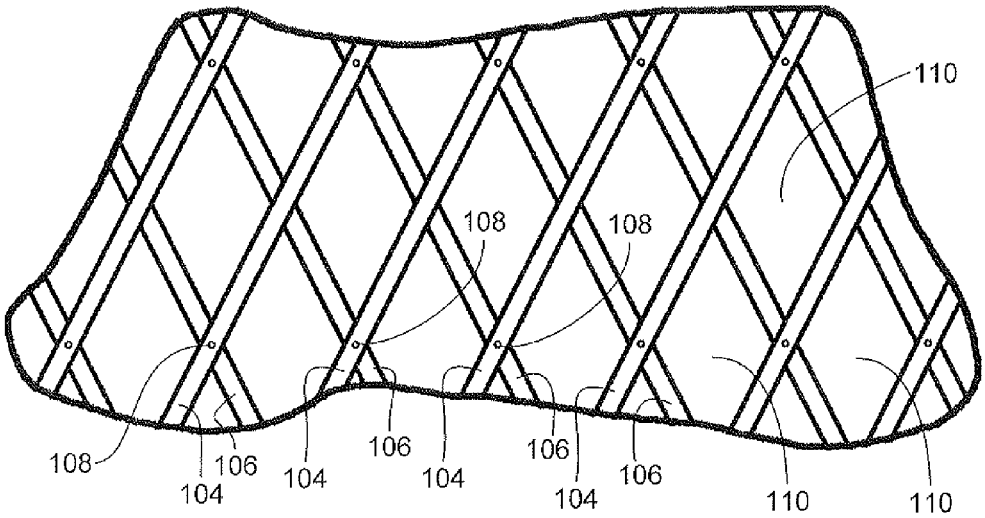
FIG. 3 is an enlarged front elevational view of a barrier structure of a gate according to an embodiment.

Referring to FIGS. 1-3, the gate 100 includes an expandable barrier structure 102 configured to span across a passageway. The barrier structure 102 prevents passage of small children and pets, for example. In the depicted construction, the barrier structure 102 comprises a plurality of discrete interlocking diagonal bars or slats 104, 106 which open in a scissors-like accordion-style configuration to an expanded position. The slats 104, 106 can be constructed of wood, plastic, or metal bars as desired. The barrier structure 102 has a first set of parallel, angularly-oriented elongated members or slats 104 in a first vertical imaginary plane, and a second set of parallel, angularly-oriented elongated members or slats 106 in a second vertical imaginary plane. The slats 104, 106 extend at a different angular orientation in the conventional manner, so that each slat 106 and 104 intersects at least one other slat from the other set. Where such slats intersect, pivot pins 108 are provided to pivotally connect the intersecting slats together for relative rotation between the two slats. The two sets of slats collectively provide an accordion-like latticework. The latticework forms a number of interior, diamond-shaped openings 110 when the latticework is expanded.

Referring to FIGS. 1A, 1B, 2A and 2B, the gate 100 has a first end 120 and an opposing lateral second end 130. The gate 100 is constructed with a first vertical end post or vertical rail 114 coupled at the first end 120 and a second vertical end post 116 is coupled to the opposing lateral second end 130, the first vertical end post 114 having central axis A. Links 109 mechanically couple the slats (106, 104) of the barrier structure 102 to the first vertical end post 114 and the second vertical end post 116. An adjustable-length horizontal rail 118 is provided at the top of the barrier structure 102 of the gate 100 in which the ends of the adjustable-length horizontal rail 118 are disposed between the first vertical end post 114 and the second vertical end post 116. The adjustable-length horizontal rail 118 is constructed of interlocking tubular sections 121 for telescopic movement to cover the top ends of the slats 104, 106 of the barrier structure 102. The first vertical end post 114 has at a higher height above the horizontal adjustable-length rail 118 than the second vertical end post 116.

The top of the first vertical end post 114 includes a gate-lock or handle-lock module 300. The gate 100 is provided with the handle-lock module 300 disposed above the adjustable-length horizontal rail 118 of the barrier structure 102. The handle-lock module 300 is sized so that a user may grasp it in the user's hand so as to enable expansion and retraction of the gate 100 in a passageway opening. The lower portion of the first vertical end post 114 includes a dock mount 132 configured to dock into a wall mount bracket 200. The second vertical end post 116 includes two hinge mounts 134, 136 laterally disposed along the length of the end post 116. The two hinge mounts 134, 136 are designed to pivotally attach in corresponding wall mount brackets 202. The first and second vertical end posts 114, 116 may be constructed of a desirable material, such as wood, molded plastic or metal.

With continued reference to FIGS. 1A, 1B, 2A and 2B, the handle-lock module 300 is disposed above the adjustable-length horizontal rail 118 of the gate 100 during use. As the accordion style barrier 102 expands across the width of a passageway opening into an extended position, the height of the expandable barrier 102 becomes shorter than that of the retracted position. In one gate construction, for example, the height of the expandable barrier 102 measured from the top of the horizontal rail 118 to the bottom of the slats 104,106 is approximately 32½ inches. While in the expanded position, the height measurement taken at the same location is approximately 30 inches.

The first end 120 of gate 100 at the adjustable length horizontal rail 118 includes a hollow tubular coupling member 126 to enable the vertical position of the horizontal rail 118 to change as the barrier structure 102 is retracted and expanded. In this configuration, the tubular coupling member 126 is slidably disposed along a length of the first vertical end post 114. In the depicted construction, the first vertical end post 114 is placed through the tubular coupling member 126 so that the coupling member 126 may freely move in a vertical manner along the end post 114. In this way, the height of the handle-lock module 300 above the horizontal rail 118 changes while the barrier structure 102 is expanded and retracted across a passageway opening. Pivot pin 108 is provided to pivotally connect the slat 106 to the coupling member 126 for relative rotational movement of the slat. Coupling member 126 prevents pinching of fingers of a human hand as the gate 100 is expanded and retracted. The tubular coupling member 126 can be of a molded plastic construction, for example of acrylonitrile butadiene styrene (ABS) plastic or nylon.

Referring to FIGS. 1A, 1B, 2C and 2D, the second end 130 of the gate 100 at the top of the second vertical end post 116 includes an optional hollow tubular corner cover 128 to enable the vertical position of the horizontal rail 118 to change as the barrier structure 102 is retracted and expanded. In the depicted construction, the upper end of the second vertical end post 116 is disposed within the tubular corner cover 128 so that the corner cover 128 may freely move in a vertical manner along a length of the end post 116. Pivot pin 108 is provided to pivotally connect the slat 104 to the corner cover 128 for relative rotational movement of the slat. The corner cover 128 also safeguards against pinch points at the corner between a wall during expansion and retraction of the barrier 102. The corner cover 128 can be made of ABS or nylon as desired.

Figure 4:
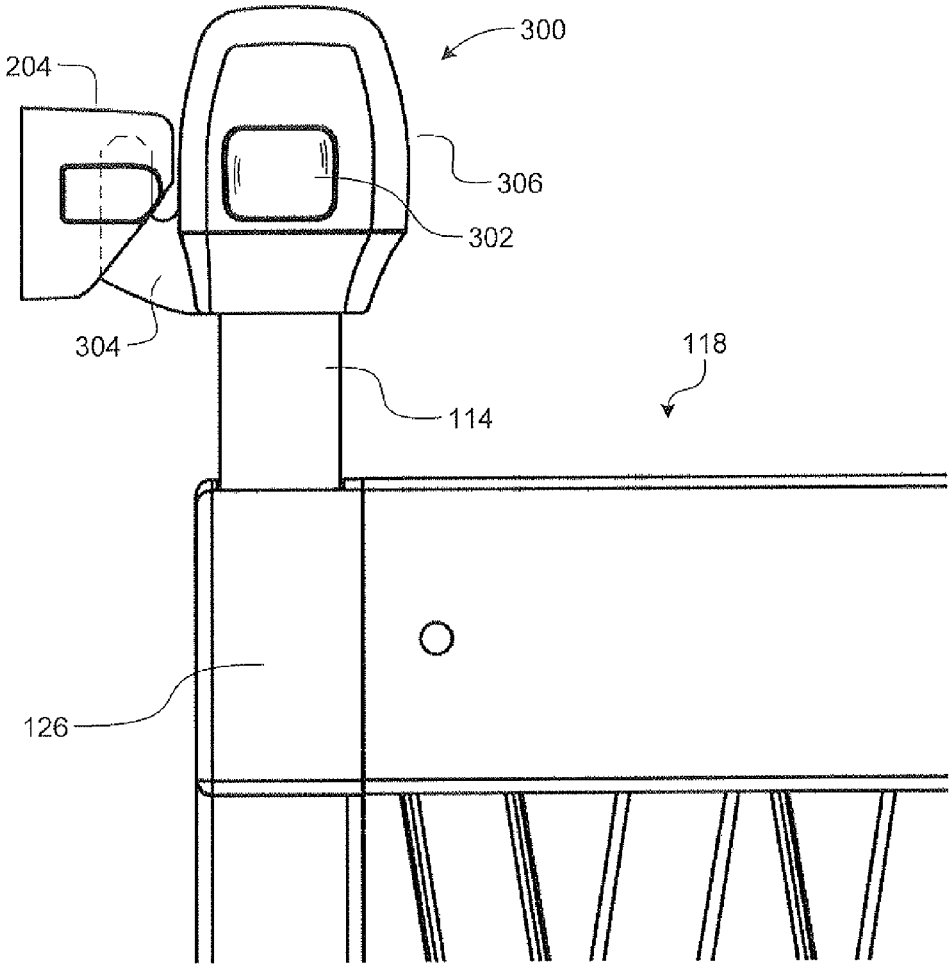
FIG. 4 is a front elevational view of a handle-lock module in a locked position engaged in a locking wall mount.
Figure 5:
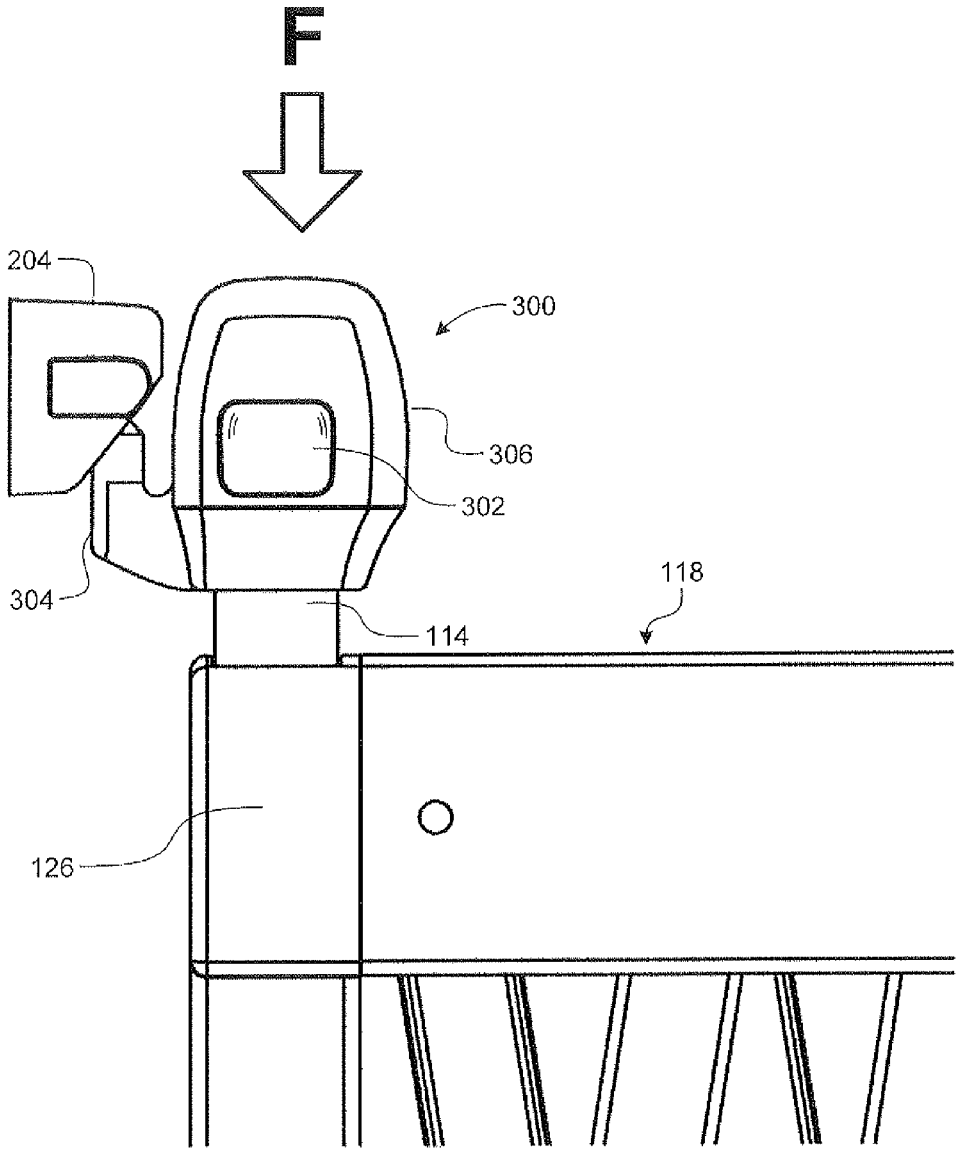
FIG. 5 is a front elevational view of the handle-lock module shown in FIG. 4 in an intermediate unlocked position in the locking wall mount.

Referring to FIGS. 4-5, the gate 100 is in a locked state when the handle-lock module 300 is engaged in the lock wall-mount bracket 204 disposed on the wall. In one construction, the handle-lock module 300 enables the user to employ at least a two motion action to unlock the gate 100 from a lock wall-mount bracket 204. To unlock the gate 100 in the depicted construction, the user may grasp the handle-lock module 300 and depress the two laterally disposed lock control members 302 towards each other. Referring to FIG. 5, then the user applies a downward force "F" on the handle-lock module 300 such that the module 300 moves telescopically downwardly along the first vertical end post 114 towards the adjustable length horizontal rail 118. As the handle-lock module 300 slidably moves downwardly along the first vertical end post 114, the locking pin or locking member 304 correspondingly moves downwardly out of the locking cavity 206 of the lock wall-mount bracket 204.

Figure 6:
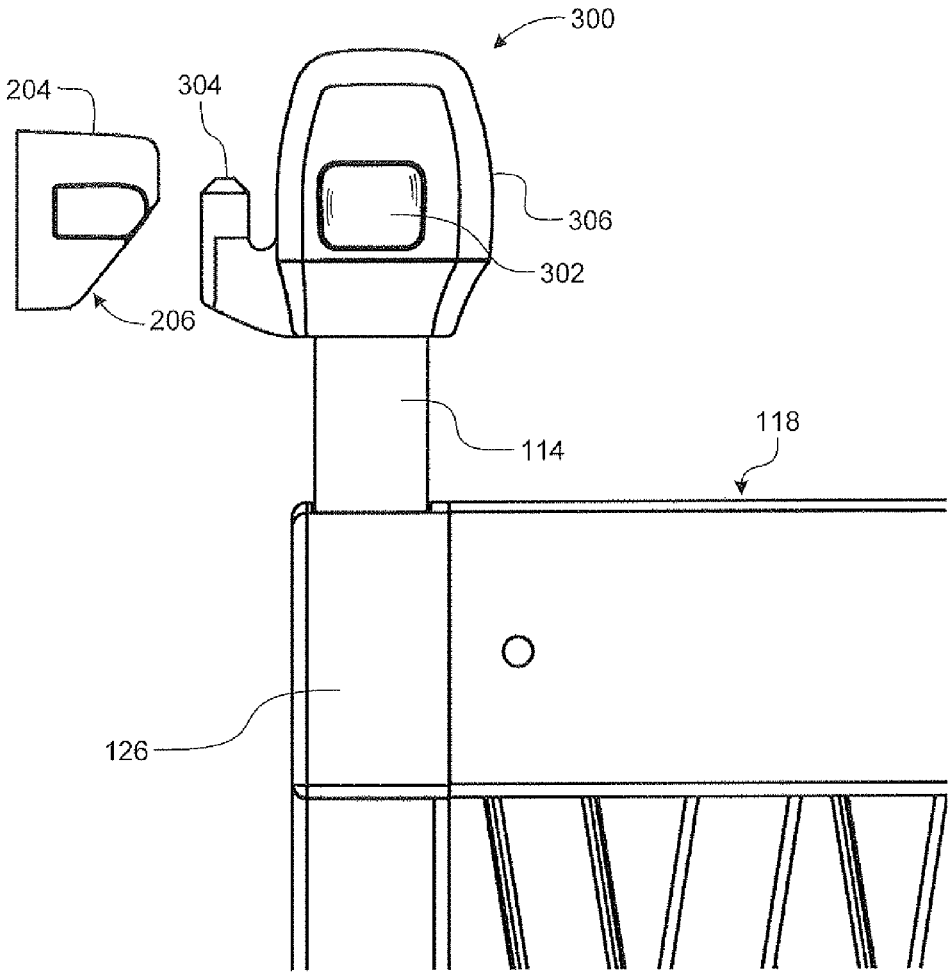
FIG. 6 is a front elevational view of the handle-lock module shown in FIG. 4 in a disengaged unlocked position from the locking wall mount.

Referring to FIG. 6, while the downward motion continues, the locking pin 304 is disengaged and becomes fully free of the locking cavity 206 of the lock wall-mount bracket 204 so that the handle-lock module 300 is free to move in any direction. As a result, the user is then able to lift the handle-lock module 300 upwardly (including the first end 120 of gate 100) such that the gate lower dock mount 132 coupled on the first vertical end post 114 is lifted upward out of its wall mount bracket 200. Then, the user is able to retract the gate 100 against the other side of the wall.

Figure 7:
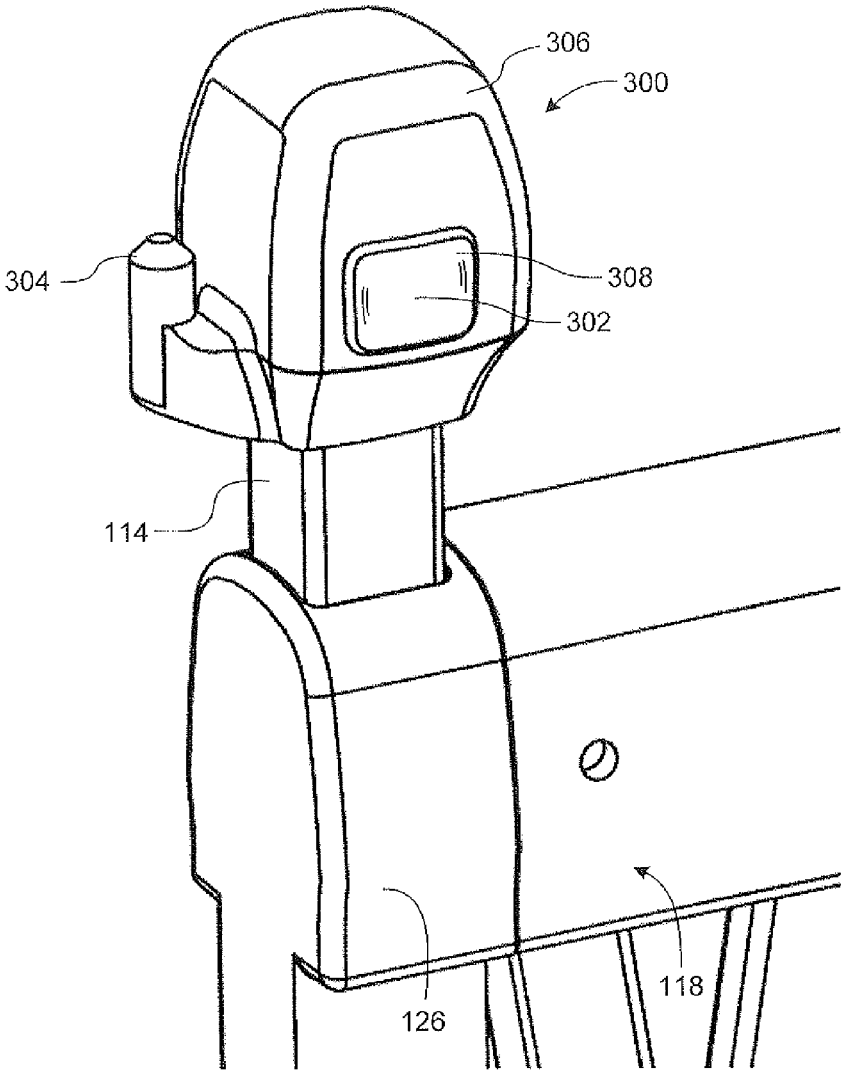
FIG. 7 is an enlarged perspective view of the handle-lock module shown in FIGS. 4-6.
Figure 8:
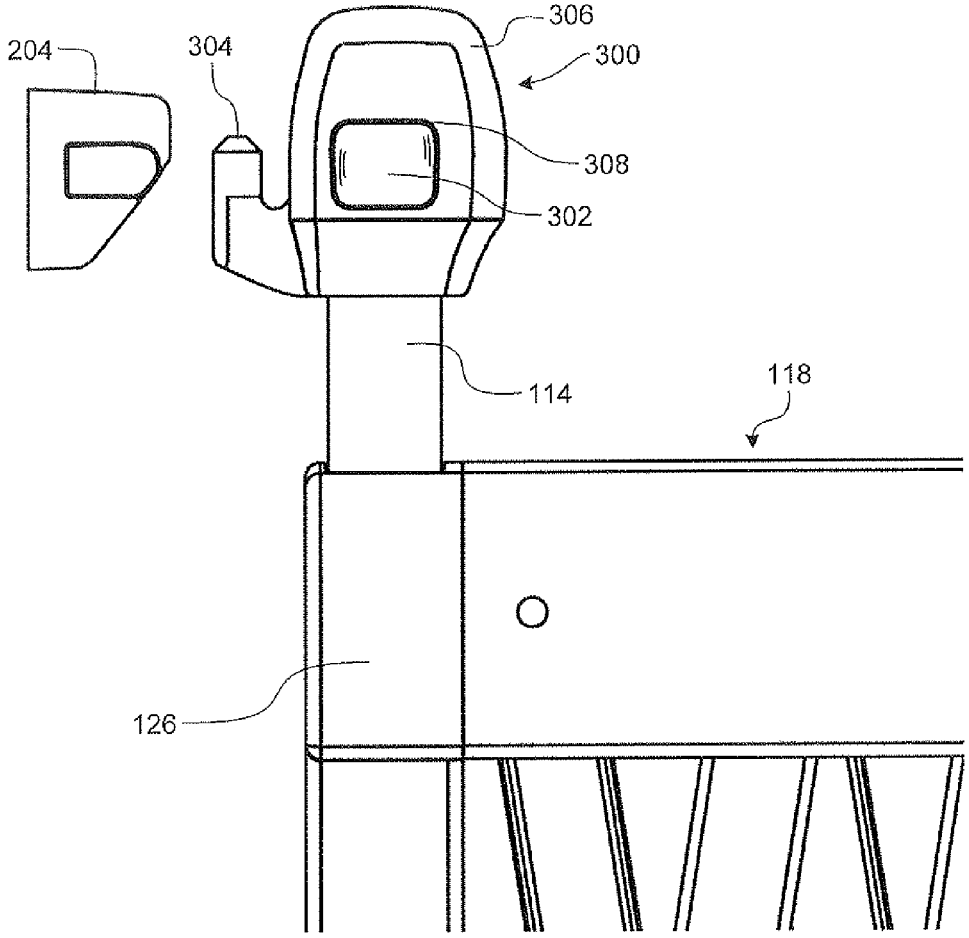
FIG. 8 is an enlarged front elevational view of the handle-lock module shown in FIGS. 4-7 and a locking wall mount.

With reference to FIGS. 7 and 8, the handle-lock module 300 includes a handle body 306 including the upwardly extending locking pin 304. In the depicted construction, the handle body 306 is a bulbous hollow shell configured to house components of handle-lock module 300. The outer surface of the handle body 306 may have a tapered arrangement to enable ease of holding the handle-lock module 300 in a hand of a user. The locking pin 304 can have any suitable cross-section to provide the locking function. In the depicted construction, the locking pin 304 has a circular cross-section. The handle body 306 includes two laterally disposed openings 308 to enable slidable movement of the compressible lock control members 302 towards each other or away from each other. The two lateral lock control members 302 are provided in the handle body 306 so that the lock control members 302 enable the unlocking of the gate 100 from its locked state or locking of the gate 100 from its unlocked state. The handle body 306 can be of a molded plastic construction, for example of acrylonitrile butadiene styrene (ABS) plastic or nylon.

Figure 9:
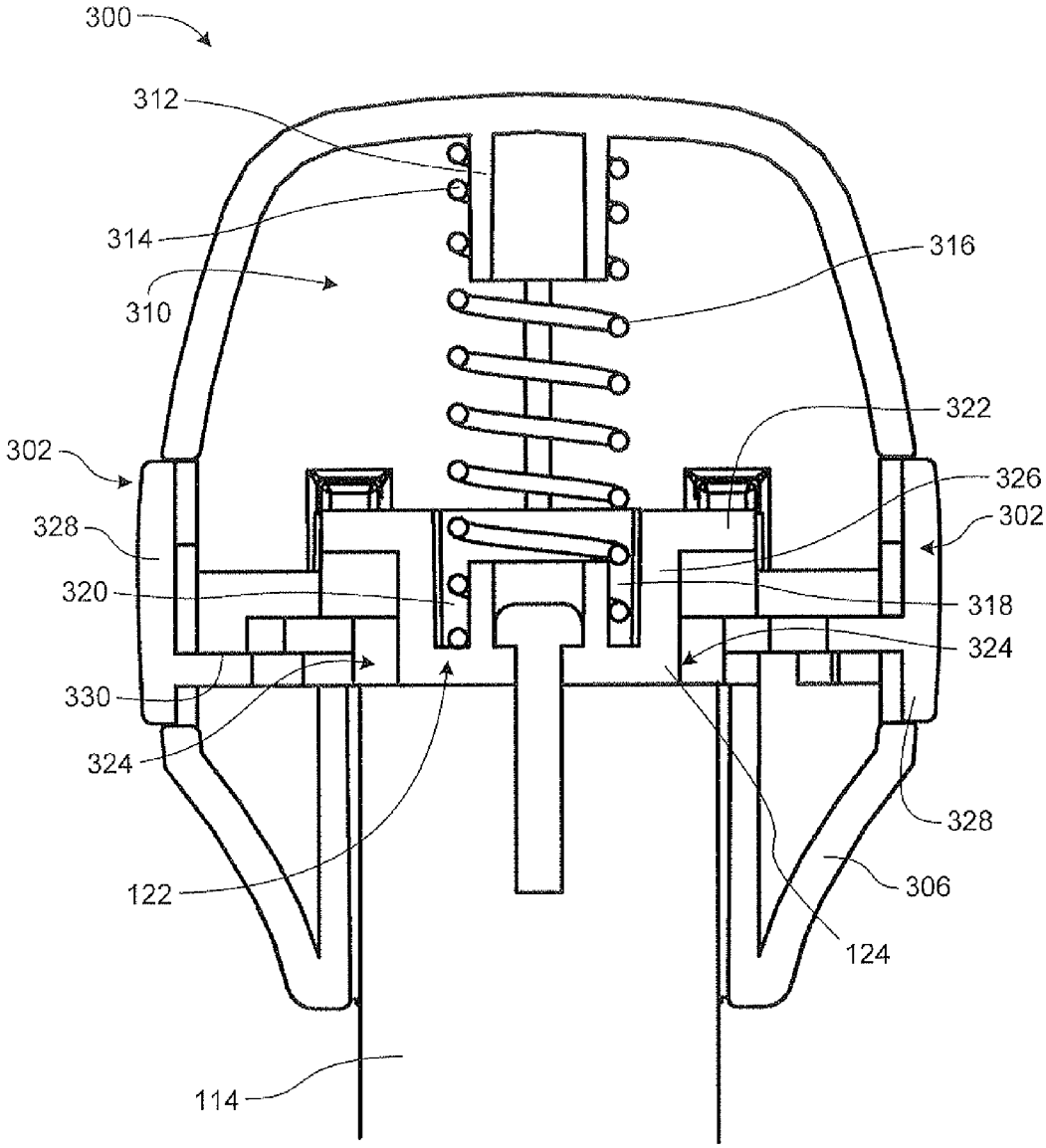
FIG. 9 is an enlarged side cross-sectional view of the handle-lock module shown in FIGS. 4-7.

Referring to FIG. 9, within the cavity 310 of the handle body 306, the upper inner wall includes a downwardly extending tubular protrusion 312 configured to retain an upper end 314 of a biasing member 316. In the depicted construction, the biasing member 316 is constructed from a helical coil spring. The upper end 314 of the biasing member 316 is pressure-fit attached to the outer surface of the tubular protrusion 312. The lower end 318 of the biasing member 316 is disposed in a circular cavity portion 320 of a coupling 322. This arrangement is intended to keep the biasing member 316 in an upright position during linear movement of the handle-lock module 300. The coupling 322 is fixedly attached to the top end 122 of the first vertical end post 114. The fixed attachment can be via any number of ways including adhesive bonding or mechanical fastening, such as a mechanical screw. The coupling 322 is sized to create a small ledge surface 324 between the coupling outer surface 326 and the outer edge 124 at the top end 122 of the first vertical end post 114. In essence, a small ledge surface 324 partially surrounds the coupling 322.

Figure 10:
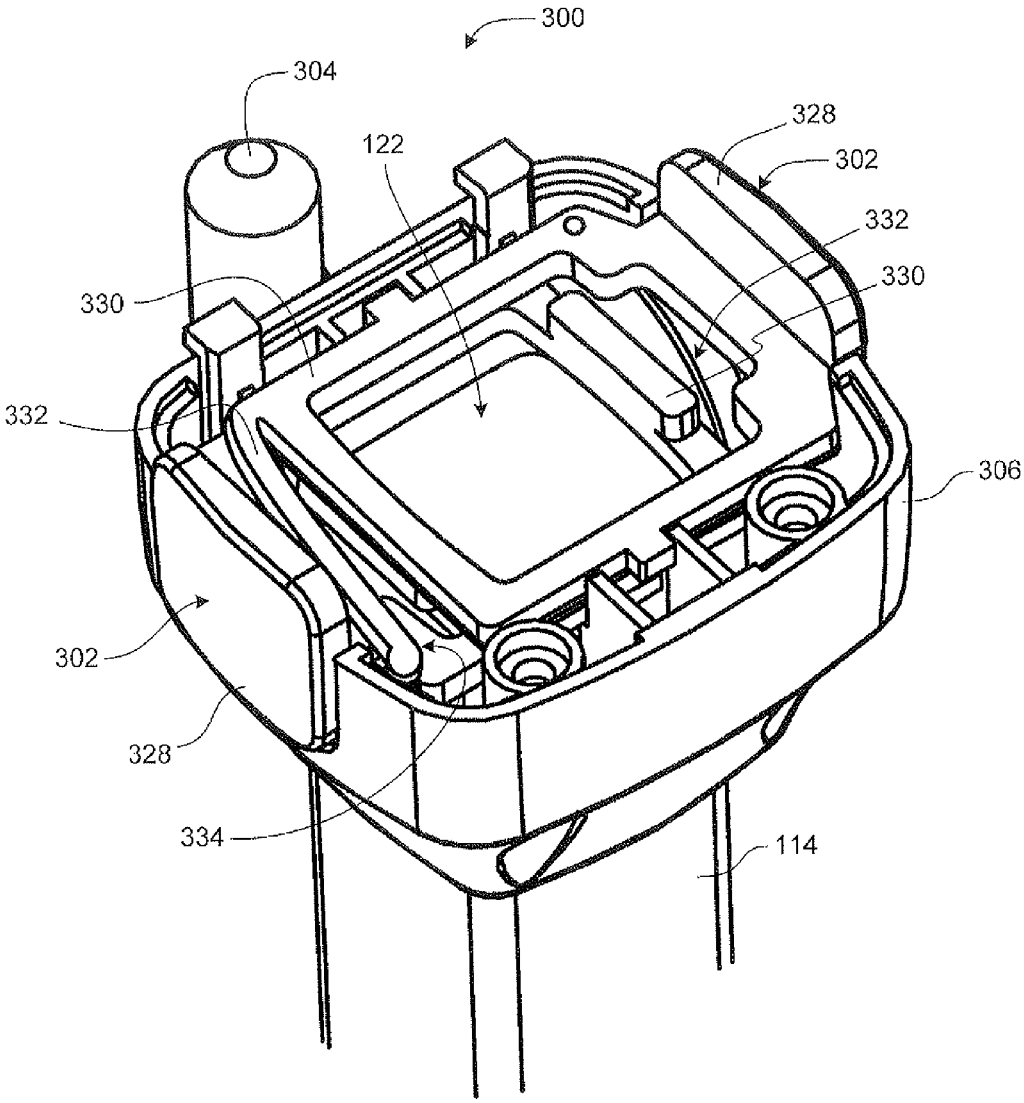
FIG. 10 is an enlarged perspective view of the handle-lock module shown in FIGS. 4-7 with the upper handle body removed to reveal the construction and the positional relationship of finger-engagable buttons within the handle-lock module in a locked position.
Figure 11:
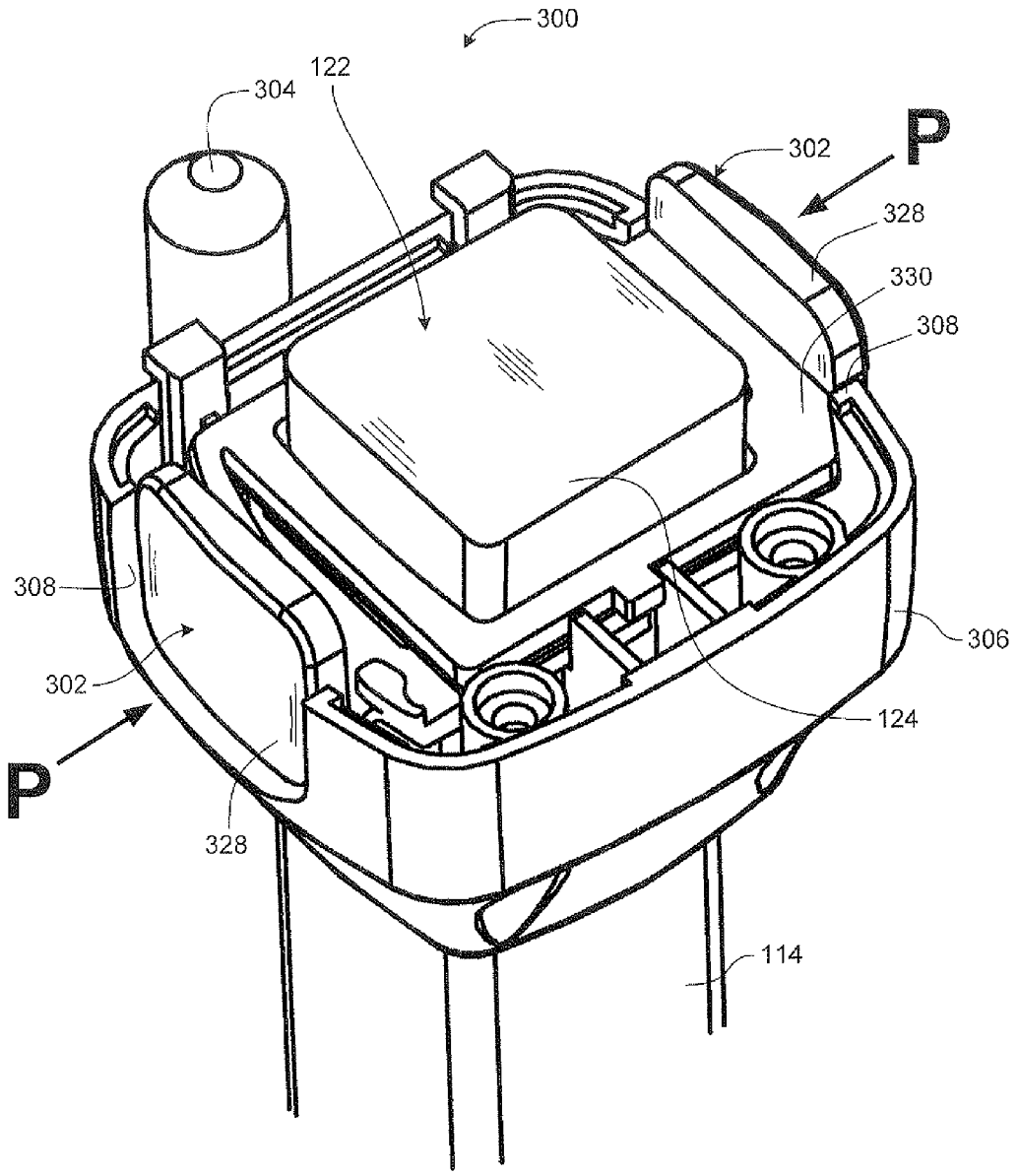
FIG. 11 is an enlarged perspective view of the handle-lock module shown in FIG. 10 in an unlocked position.

Referring to FIGS. 10 and 11, each of the lock control members 302 is provided with an exposed button member 328 coupled to an open rectangular frame member 330, which is coupled to a resiliently biased member 332, such as a leaf spring. The lock control members 302 are resiliently biased to extend away from each other, in that the leaf springs 332 are designed to resist movement during a compression force "P" of the button members 328 towards each other in opening 308. (See FIG. 11) The lock control members 302 have a nested arrangement in which at least one biased member 332 is received in a slot 334 of the frame member 330 of the other lock control member. As shown in FIG. 11, the top end 122 of the first vertical end post 114 is enabled to pass through the open area of the frame members 330. This pass-through movement occurs during the downward movement of handle-lock module 300 in the course of an unlocking operation. The lock control members 302 and coupling 322 can be of a molded plastic construction, of ABS or nylon, for example.

Figure 12:
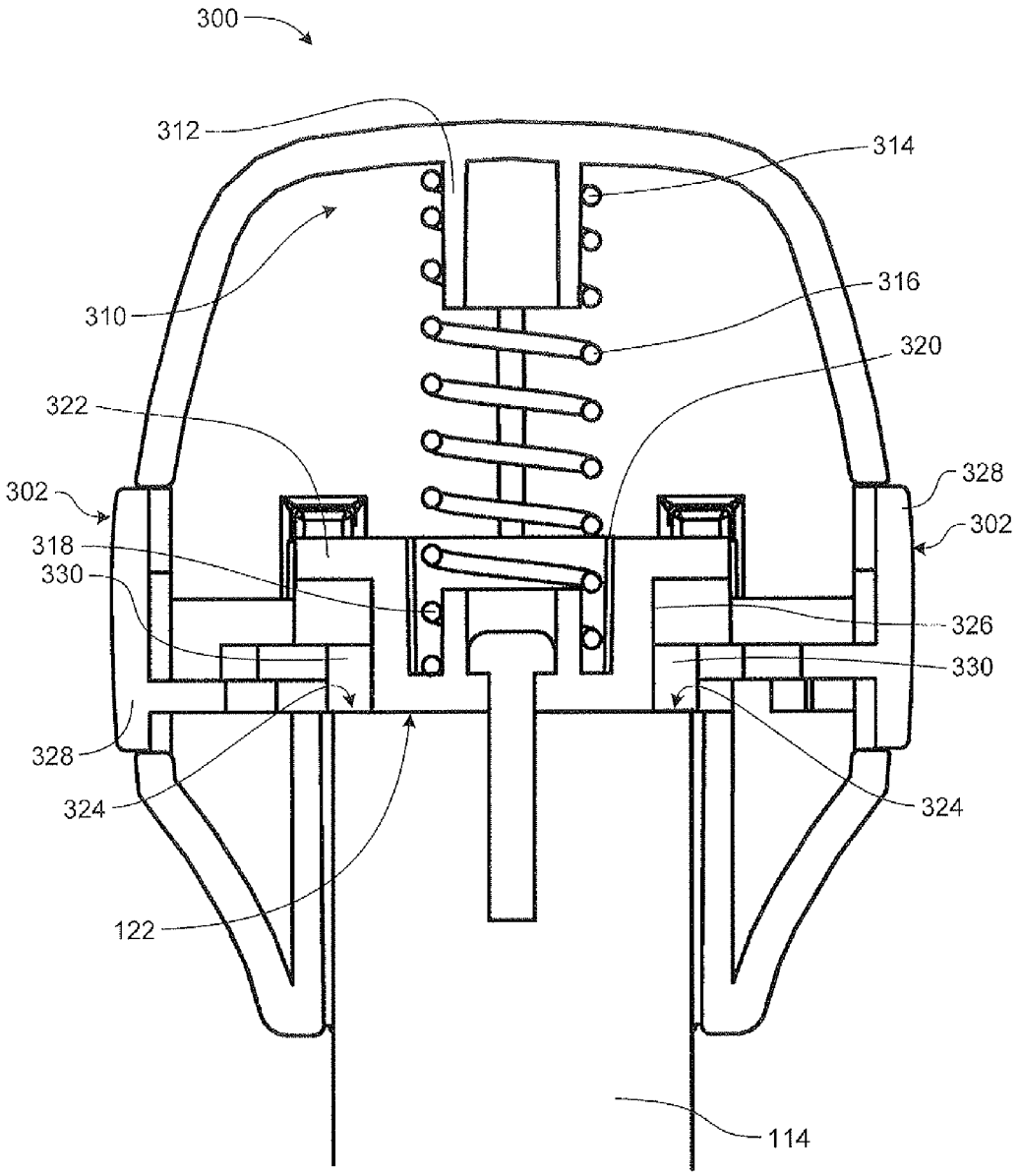
FIG. 12 is an enlarged side cross-sectional view of the handle-lock module shown in FIGS. 4-7 with the handle-lock module in a locked position.
Figure 13:
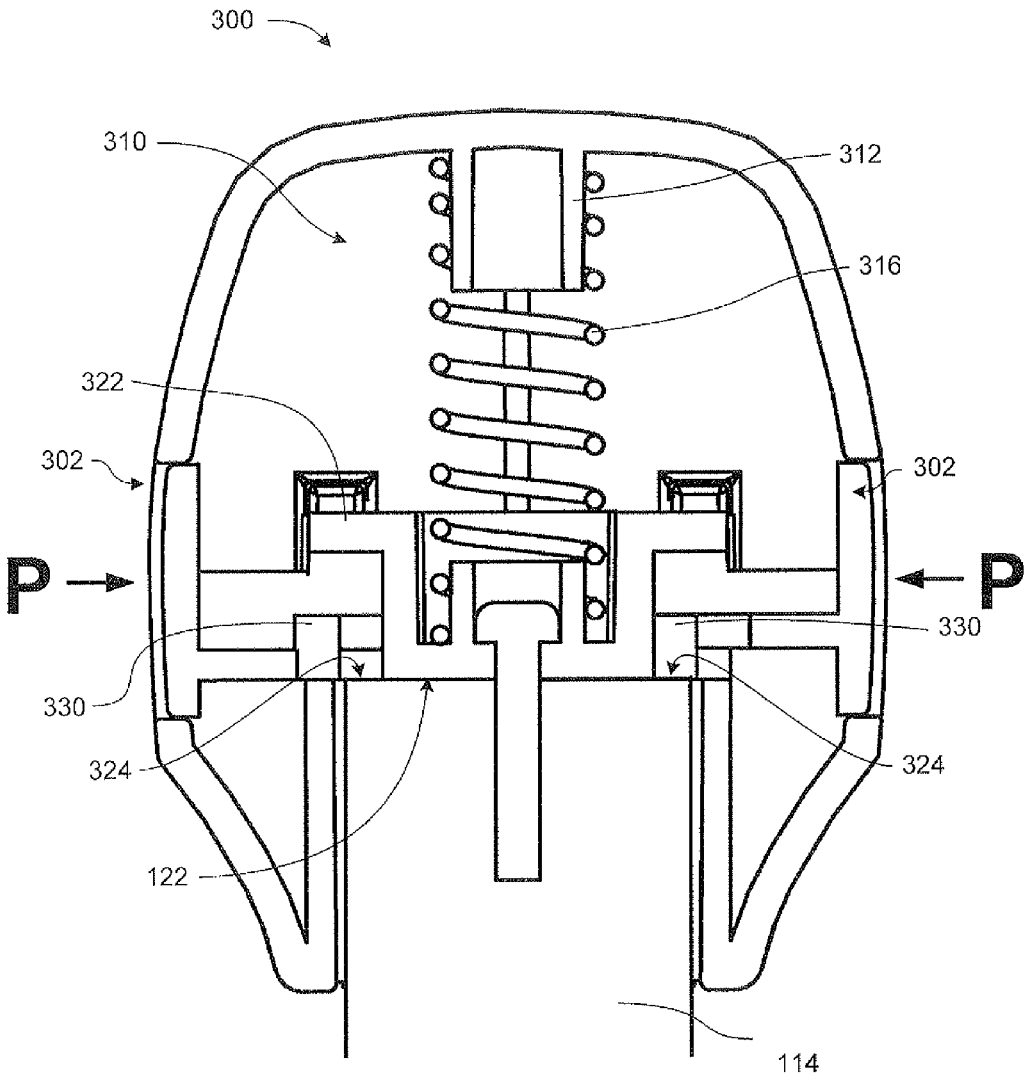
FIG. 13 is an enlarged side cross-sectional view of the handle-lock module shown in FIGS. 4-7 with the handle-lock module in an initial unlocked position showing compression of finger-engagable buttons.
Figure 14:
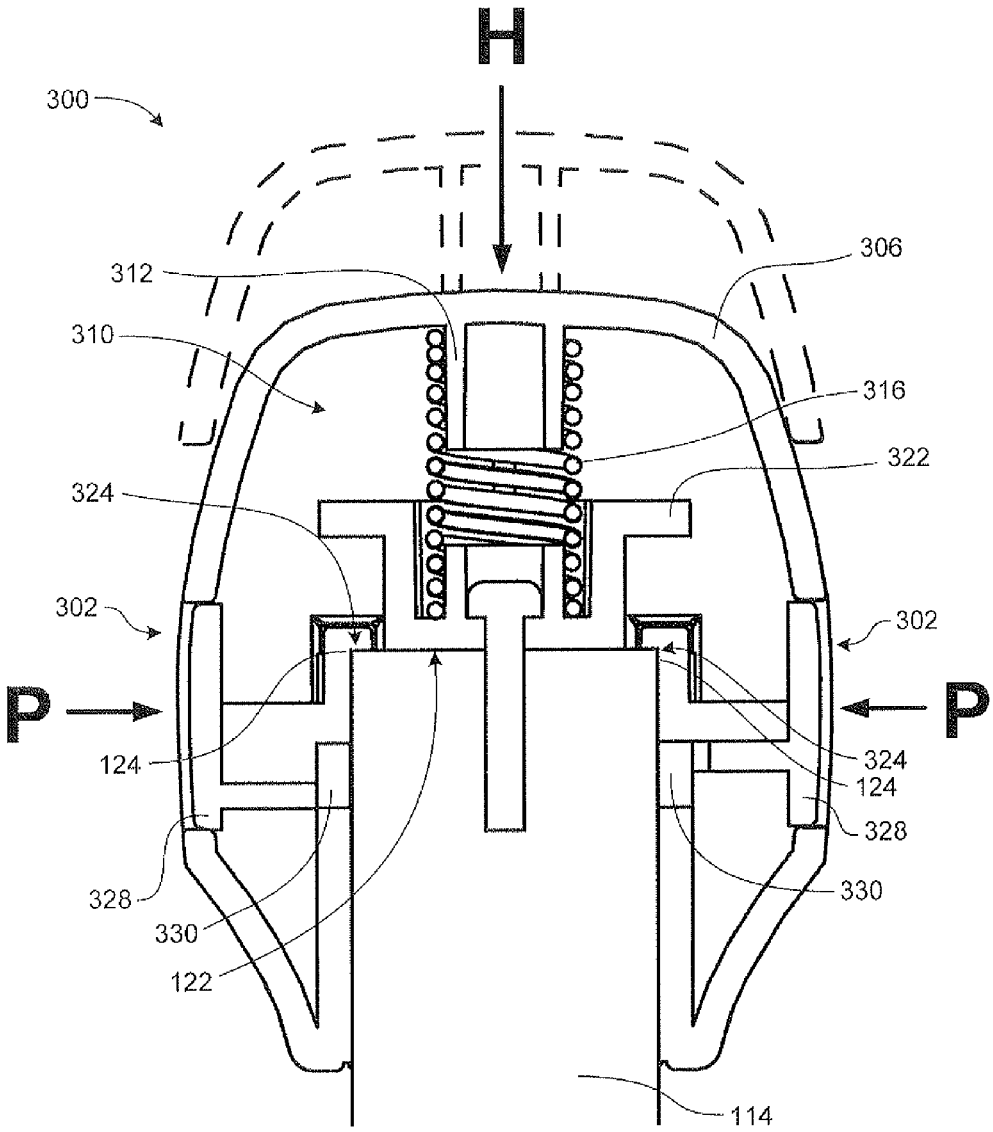
FIG. 14 is an enlarged side cross-sectional view of the handle-lock module shown in FIGS. 4-7 with the handle-lock module in an unlocked position showing movement of the finger-engagable buttons and a positional relationship of the handle-lock module along a length of a vertical end post.

Referring to FIGS. 12-14, when the handle-lock module 300 is in the locked state, the biasing member 316 has pushed the handle-lock module 300 upwardly in a locking position. The coupling 322 of the handle body 306 is sized to create a small ledge surface 324 between the coupling outer surface 326 and the outer edge of the first vertical end post 114. Each of the two laterally disposed lock control members 302 has a portion of the frame member 330 resting on the ledge surface 324 of the first vertical end post 114. This configuration stops downward movement of the handle-lock module 300 until the user applies a lateral compressive pressure "P" to the lock control members 302 to release the handle-lock module 300 from the locked position.

To unlock the gate, the user depresses the two lock control members 302 towards each other with compressive pressure "P" as shown in FIG. 13. This depression or compression action slides a portion of the frame member 330 away from the ledge surface 324 of the end post 114 such that the handle body 306 is released to slide along a length of the first vertical end post 114. As shown in FIG. 14, the user then pushes downwardly on the handle body 306. Further downward force "H" on the handle body 306, pushes it downwardly along the vertical end post 114; as a result, the biasing member 316 becomes compressed due to the downward force H overcoming the opposing biasing force. Furthermore, the top end 122 of the first vertical end post 114 passes through the open area of the frame members 330. While not shown in FIG. 14, the locking pin 304 will eventually become free from the locking cavity 206 of the lock wall-mount bracket 204.

As can be readily understood by one of skill in art from FIGS. 12-14, to place the gate 100 in the locked state, the biasing member 316 of the handle body 306 moves the handle body 306 upwardly along the first vertical end post 114. During this upward movement, the inner surfaces of the frame members 330 slide along the vertical end post surface until they reach the top end 122. The leaf spring 332 on each of the frame members 330 biasedly engages the frame members 330 to laterally slide onto the upper ledge surface 324 of the first vertical end post 114. Consequently, the frame members 330 slide into position in handle body 306 onto the upper ledge 324 where the handle-lock module 300 is placed in its rested locked position.

Figure 15:
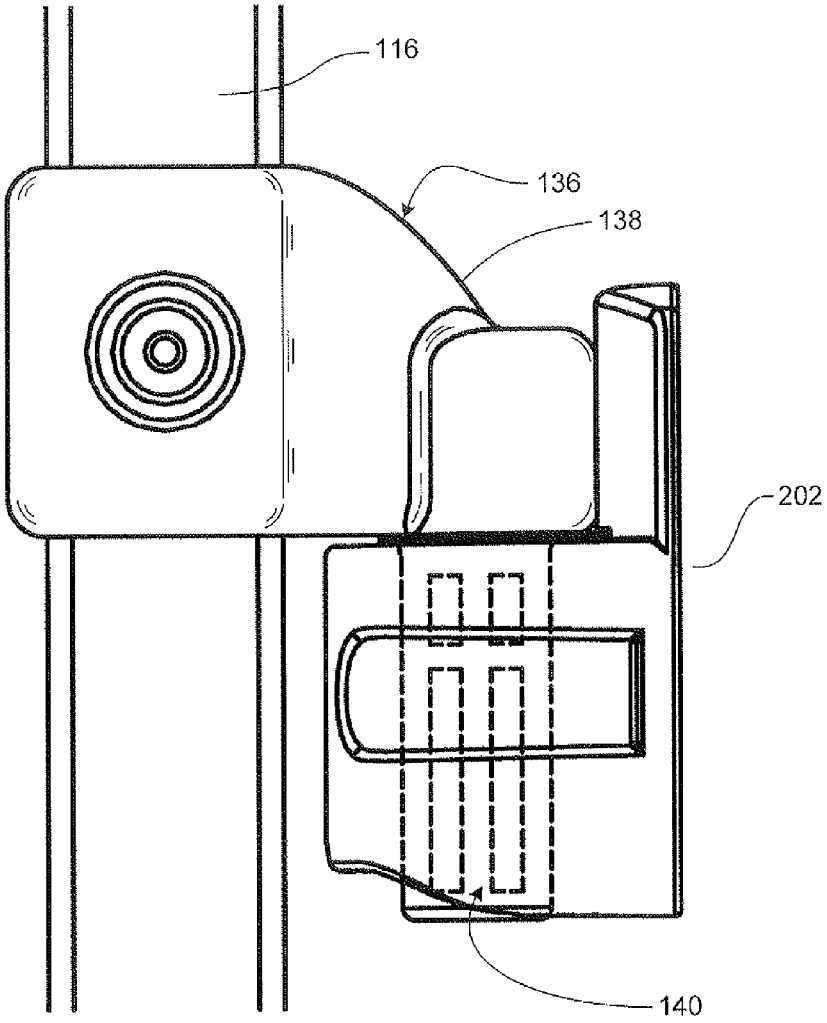
FIG. 15 is an enlarged front elevational view of a hinge mount construction engaged in a wall mount bracket.

Referring to FIG. 15, a hinge mount construction 136 includes a mount body 138 having a downwardly extending hinge pin 140 which docks within a cavity of a wall mount bracket 202. The hinge pin 140 can have a suitable cross-section to provide a door-like hinge function. In the depicted construction, the hinge pin 140 has a circular cross-section.

Figure 16A:
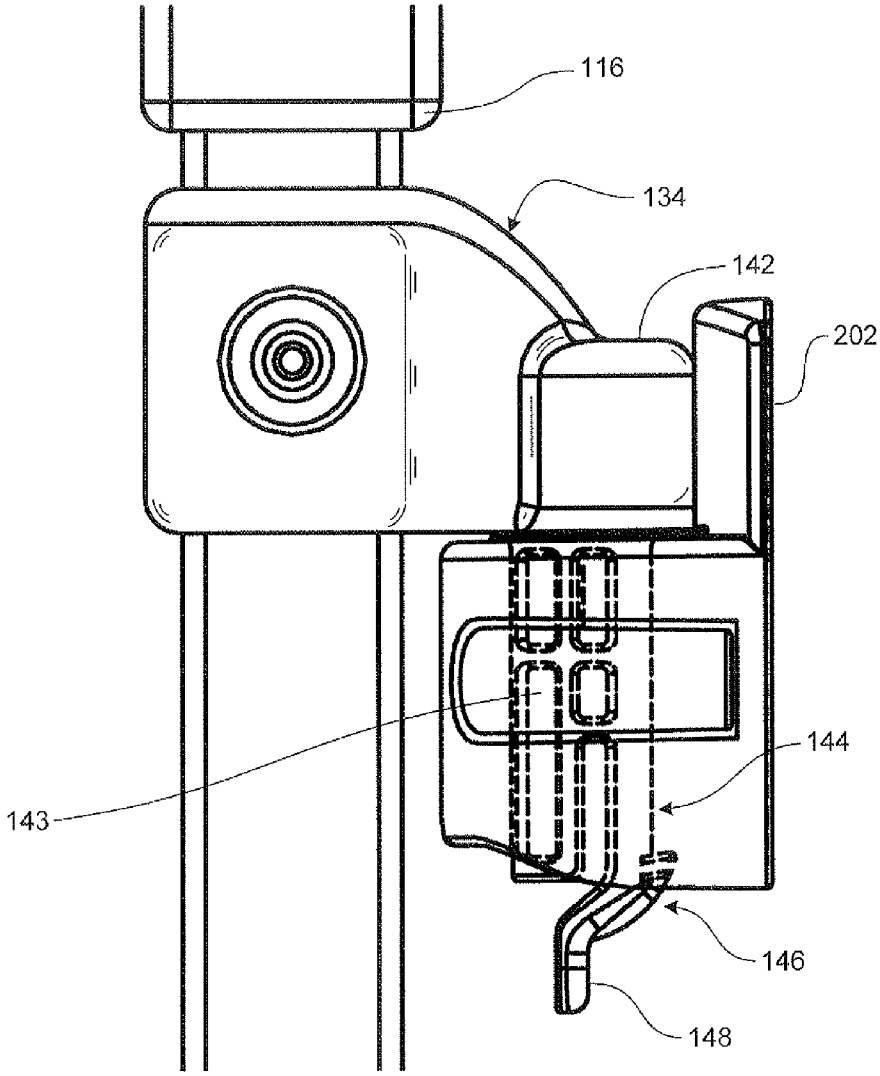
FIG. 16A is an enlarged front elevational view of an alternative hinge mount construction engaged in a wall mount bracket.
Figure 16B:
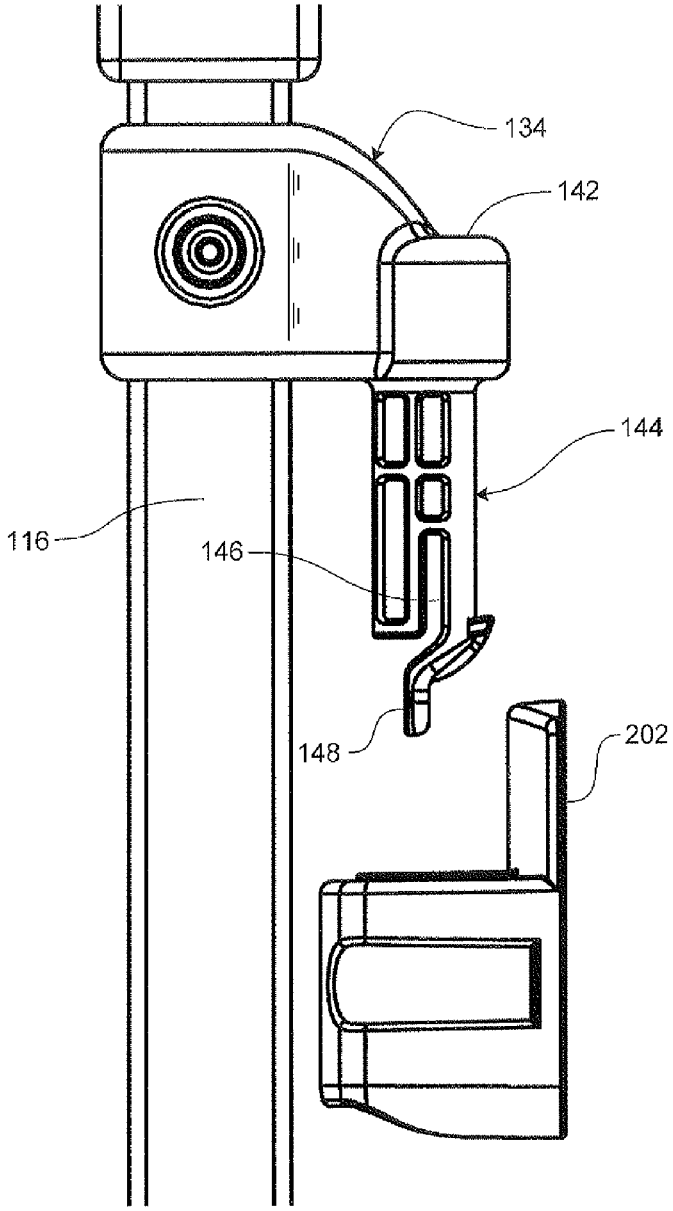
FIG. 16B is an exploded assembly view of the alternative hinge mount construction shown in FIG. 16A.

Referring to FIGS. 16A and 16B, an alternative hinge mount construction 134 is shown. The hinge mount 134 includes a mount body 142 having a hinge pin 143 including a downward extension leg 144 being biased to provide a snap-fit engagement with wall mount bracket 202. The extension leg 144 of the hinge mount 134 includes a tab 146 at a distal end 148 enabling the extension leg 144 to be released from the wall mount bracket 202 upon application of a lateral force. The snap-fit engagement prevents the gate 100 from being raised inadvertently out of the wall mount bracket 202. The hinge pin 143 can have a suitable cross-section to provide a door-like hinge function. In the depicted construction, the hinge pin 143 has a circular cross-section.

Figure 17:
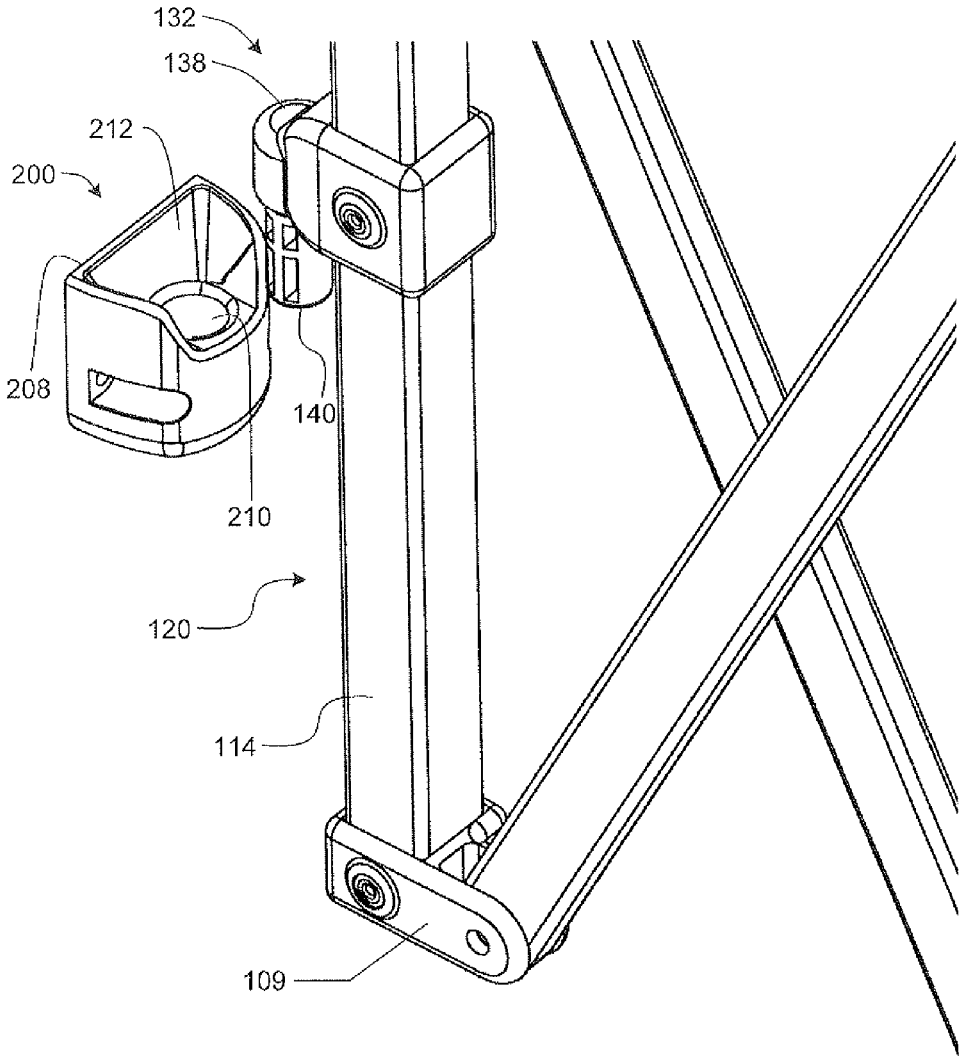
FIG. 17 is an enlarged front perspective view of a wall mount construction and a corresponding gate dock mount.

Referring to FIG. 17, a dock mount 132 has the same construction as hinge mount 136 in FIG. 15. Wall mount bracket 200 is provided for receiving and docking with pin 140. The wall mount bracket 200 includes an upper ledge 208 and a cylindrical recess 210 for receiving pin 140 of dock mount 132. There is provided an angled transition surface 212 extending from the upper ledge 208 to the cylindrical recess 210 to help guide the pin 140 of dock mount 132 into the cylindrical recess 210. The wall mount brackets 200 and 202 can be of a molded plastic construction, for example of ABS or nylon.

As can be appreciated, a user can grasp the handle-lock module 300 in one hand to lift the gate upward or to mount the gate into wall bracket 200. The gate having an accordion-like latticework enables the user to tilt or incline the upper part of gate 100 and aim the docking pin 140 into the wall bracket 200. In this way, the gate 100 provides locating benefit for single handed operation when closing or opening the gate in a passageway.

Figure 18:
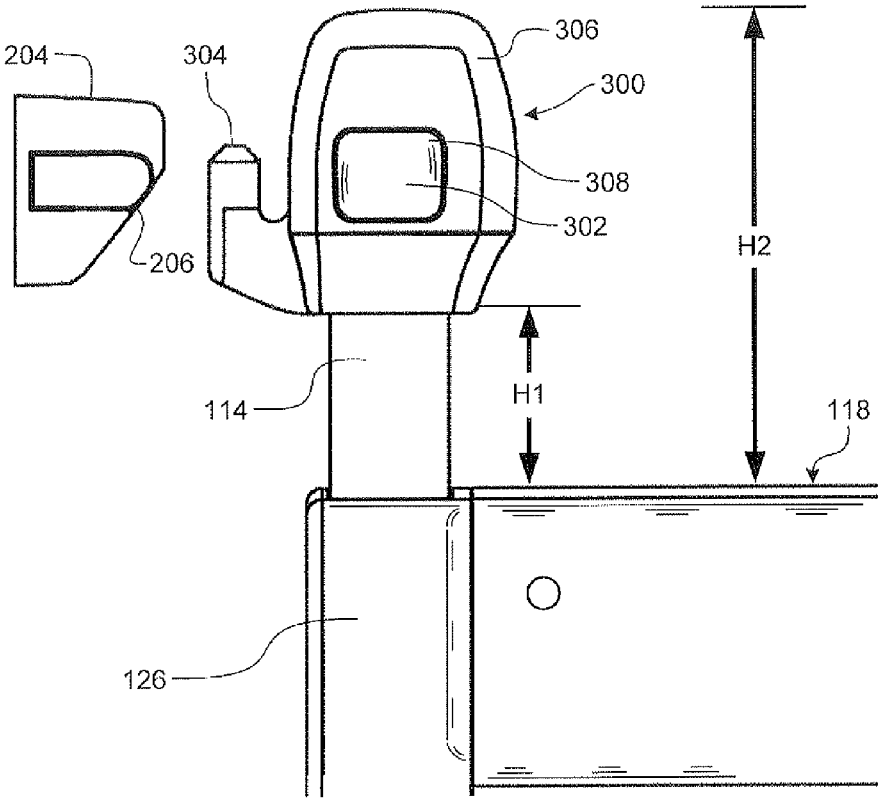
FIG. 18 is an enlarged front elevational view of the handle-lock module shown in FIGS. 4-7 and a locking wall mount with dimensional characteristics of the handle-lock module.

Referring to FIG. 18, in one gate construction, the height H1 of the handle-lock module 300 above the adjustable-length horizontal rail 118 is approximately 1.0 inch when the gate 100 is in the compact/retracted position (as measured from the bottom of the module 300). Likewise, the height H1 the handle-lock module 300 above the adjustable-length horizontal rail 118 is approximately 4.0 inches above when the gate 100 is in the expanded position (as measured from the bottom of the module 300). Hence, the height H1 may range between 1.0 inch to 4.0 inches. In that the handle-lock module 300 moves downwardly during an unlocking operation, the handle-lock module 300 may vertically travel at least ½ inch to affect the locking and unlocking of the gate 100. In this way, the locking pin 304 can travel downwardly ½ inches to be free from the cavity 206 of the lock wall-mount bracket 204. Nevertheless, other dimensional values are possible for various gate constructions.

In an alternative gate construction, the height H2 of the handle-lock module 300 as measured from the top of the handle-lock module 300 to the top of the adjustable-length horizontal rail 118 is 3.0 inches when the gate 100 is in the compact/retracted position. Likewise, the height H2 of the handle-lock module 300 as measured from the top of the handle-lock module 300 to the top of the adjustable-length horizontal rail 118 is 6.0 inches when the gate 100 is in the expanded position. Nevertheless, other dimensional values are possible for various gate constructions.

Figure 1A:
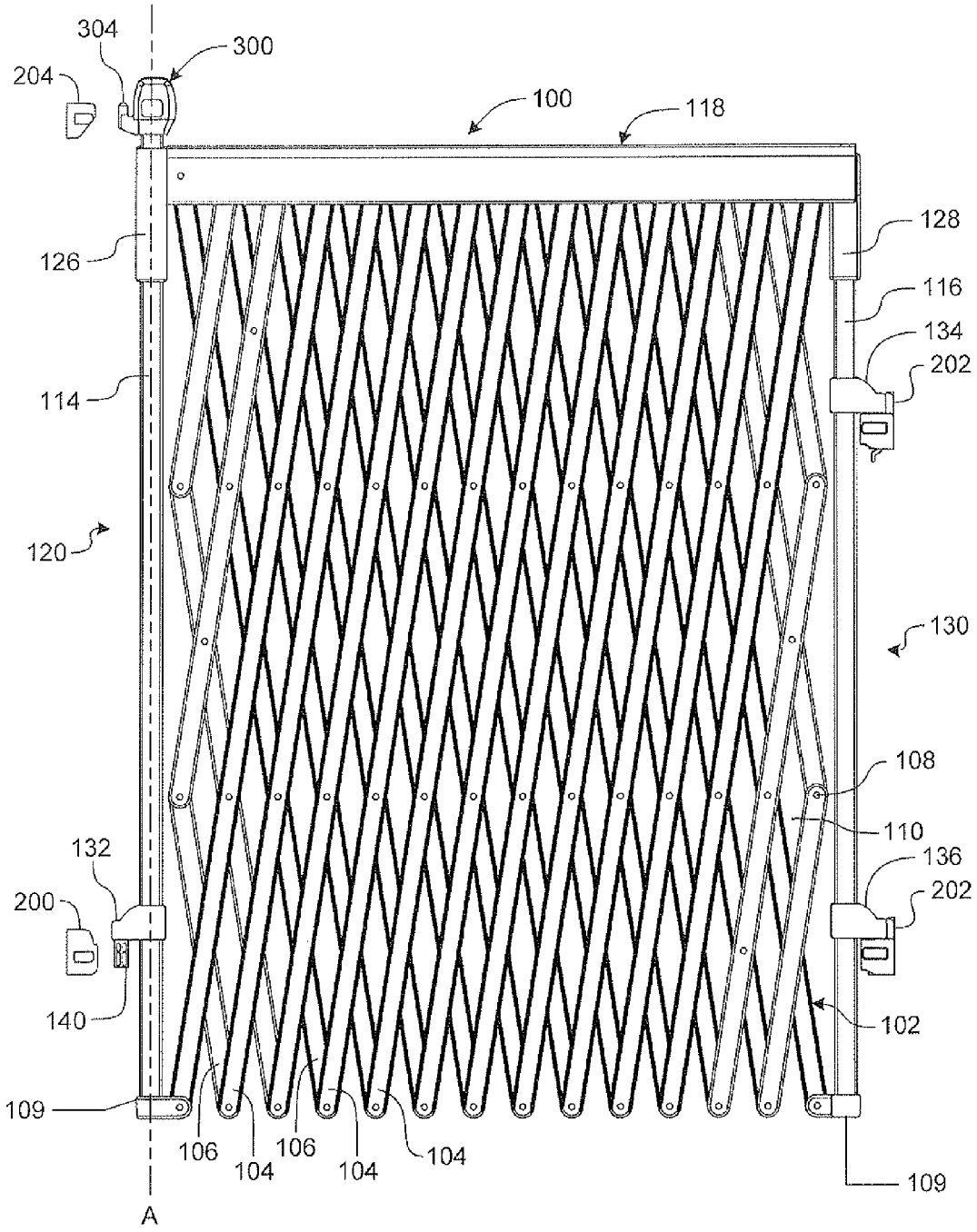
FIG. 1A is a front elevational view of the gate system in a retracted position and unlocked state according to an embodiment.
Figure 1B:
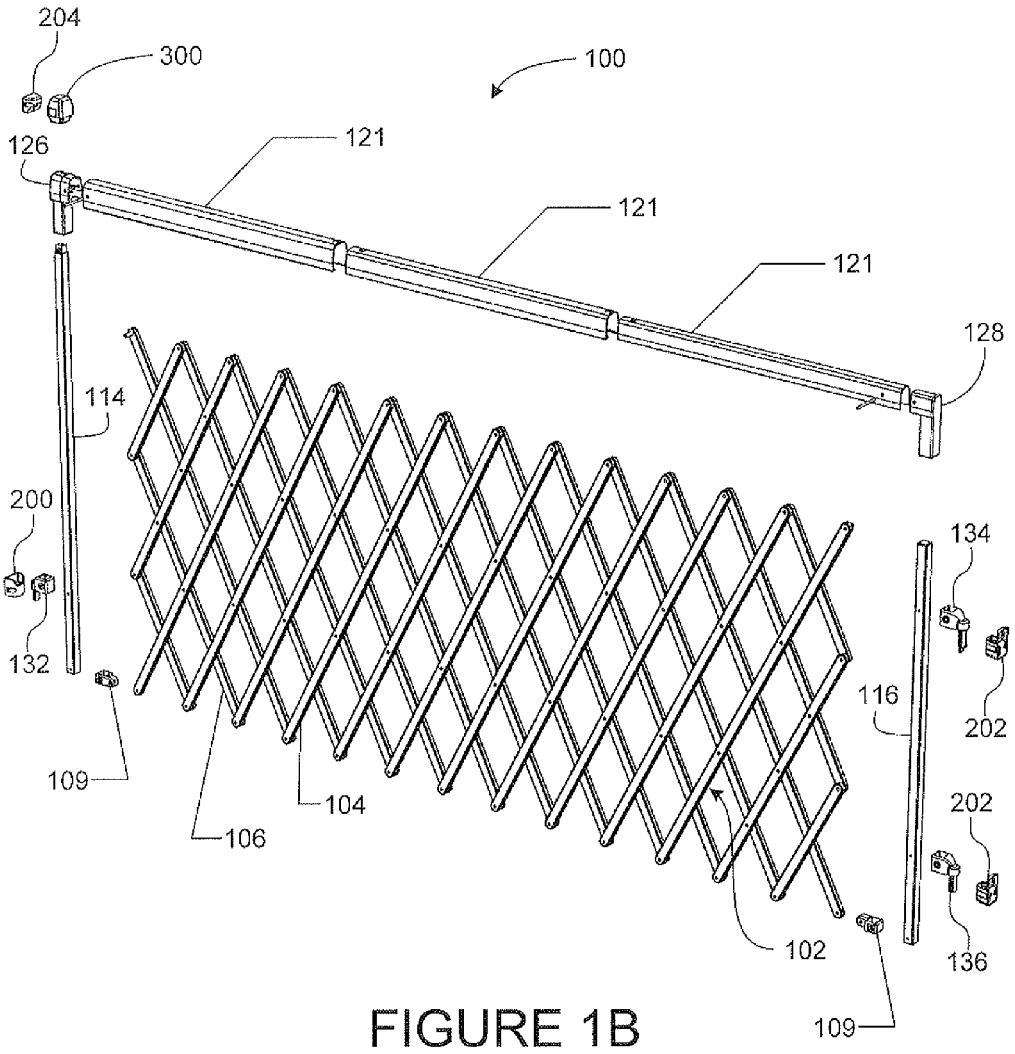
FIG. 1B is an exploded assembly view of the gate system of FIG. 1A.
Figure 2A:
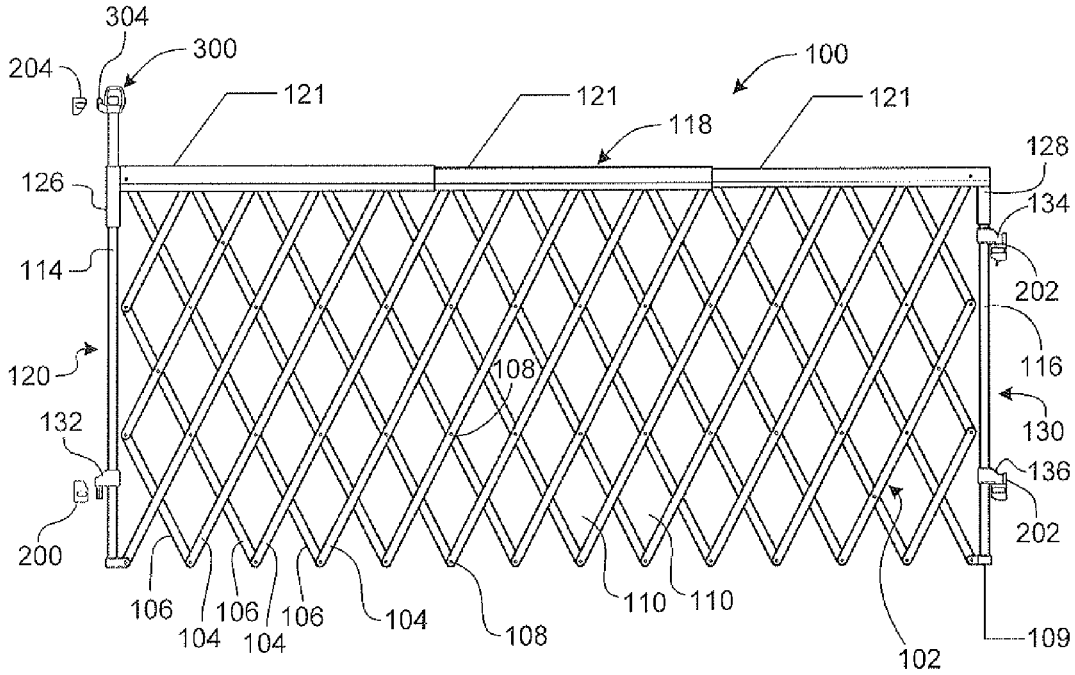
FIG. 2A is a front elevational view of the gate system of FIG. 1A in an expanded position and unlocked state.
Figure 2B:
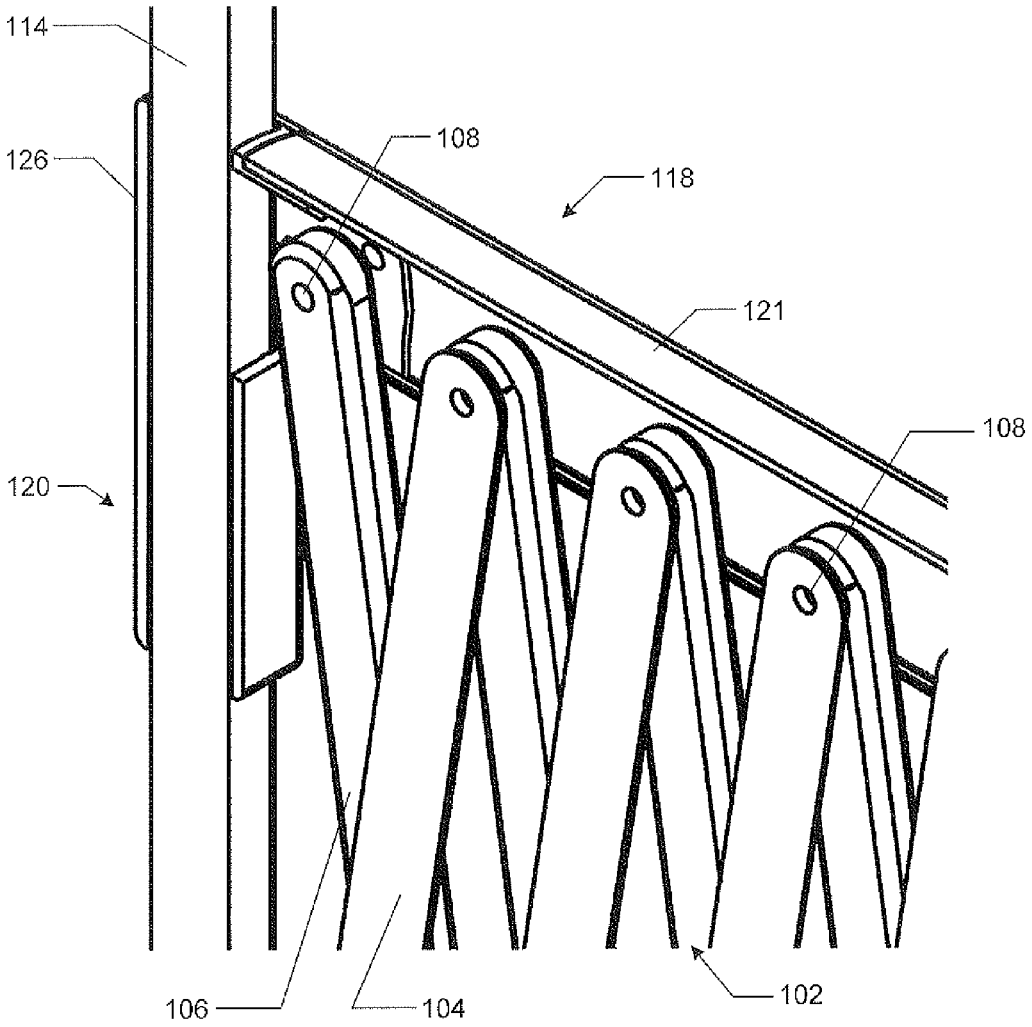
FIG. 2B is a fragmentary perspective cross-sectional view of the gate system of FIG. 1A showing an adjustable-length horizontal rail, first vertical end post, and barrier structure construction.
Figure 2C:
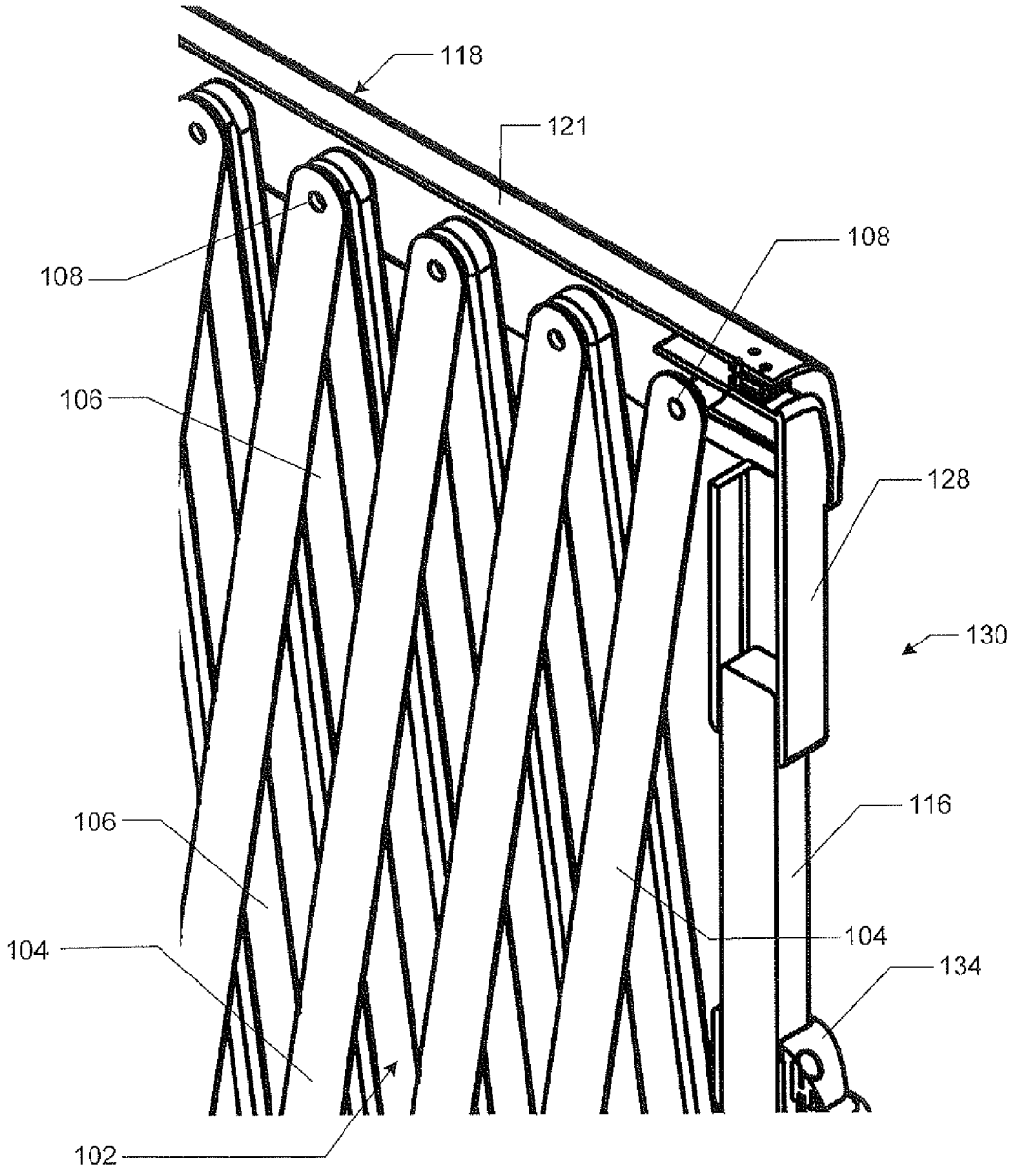
FIG. 2C is a fragmentary perspective cross-sectional view of the gate system of FIG. 1A showing an adjustable-length horizontal rail, second vertical end post, and barrier structure in a retracted position.
Figure 2D:
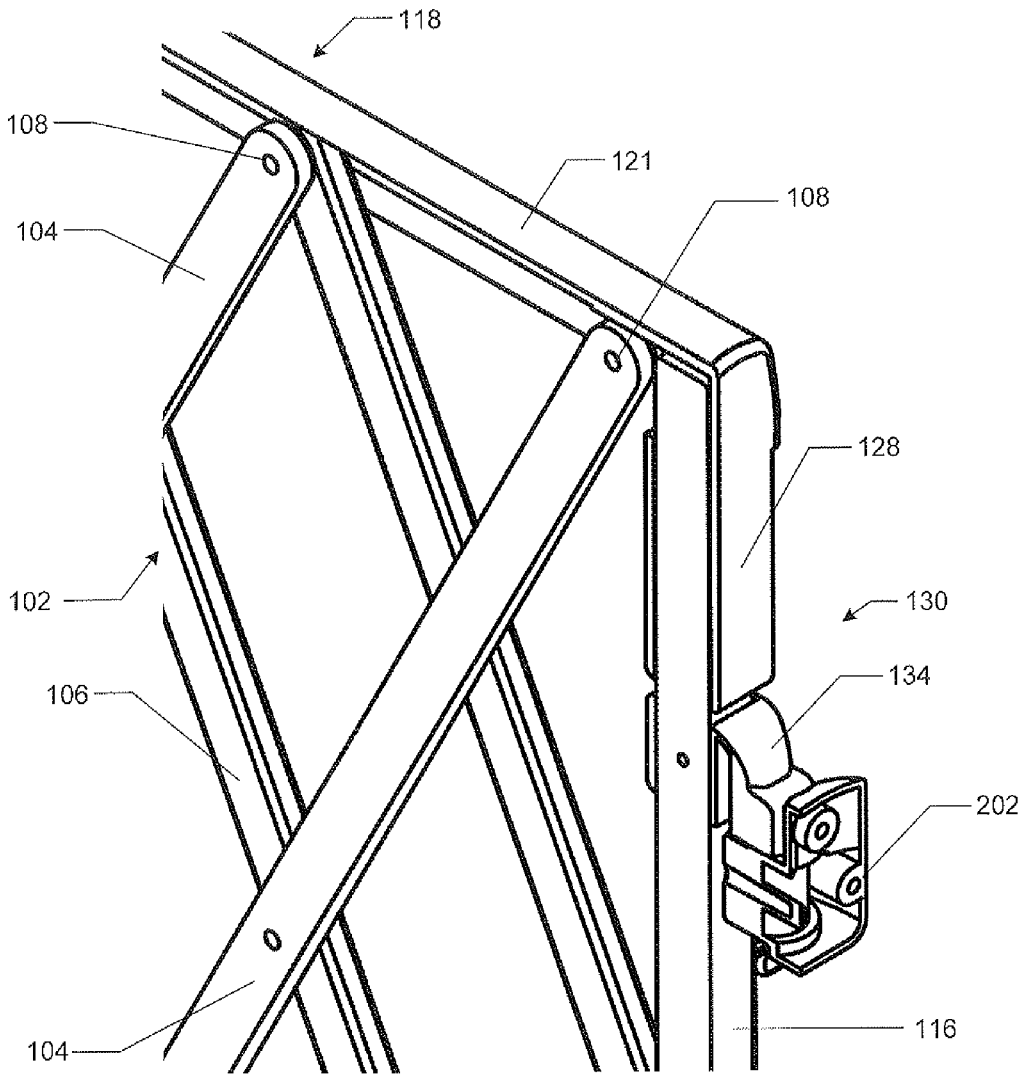
FIG. 2D is a fragmentary perspective cross-sectional view of the gate system of FIG. 1A showing an adjustable-length horizontal rail, second vertical end post, and barrier structure in an expanded position.

Referring to FIG. 1A, at the first end 120 of the gate 100, the upwardly extending locking pin 304 and the downward extending docking pin 140 are coaxially disposed. Likewise to provide the door-like swing function, downwardly extending hinge pins 140 and 143 (as shown in FIGS. 15 and 16A-16B) are coaxially located via the wall mount brackets 202. It is noted that locking pin 304 may be biased away from the docking pin 140 to maintain the gate 100 in a connected and locked state.

Figure 19:
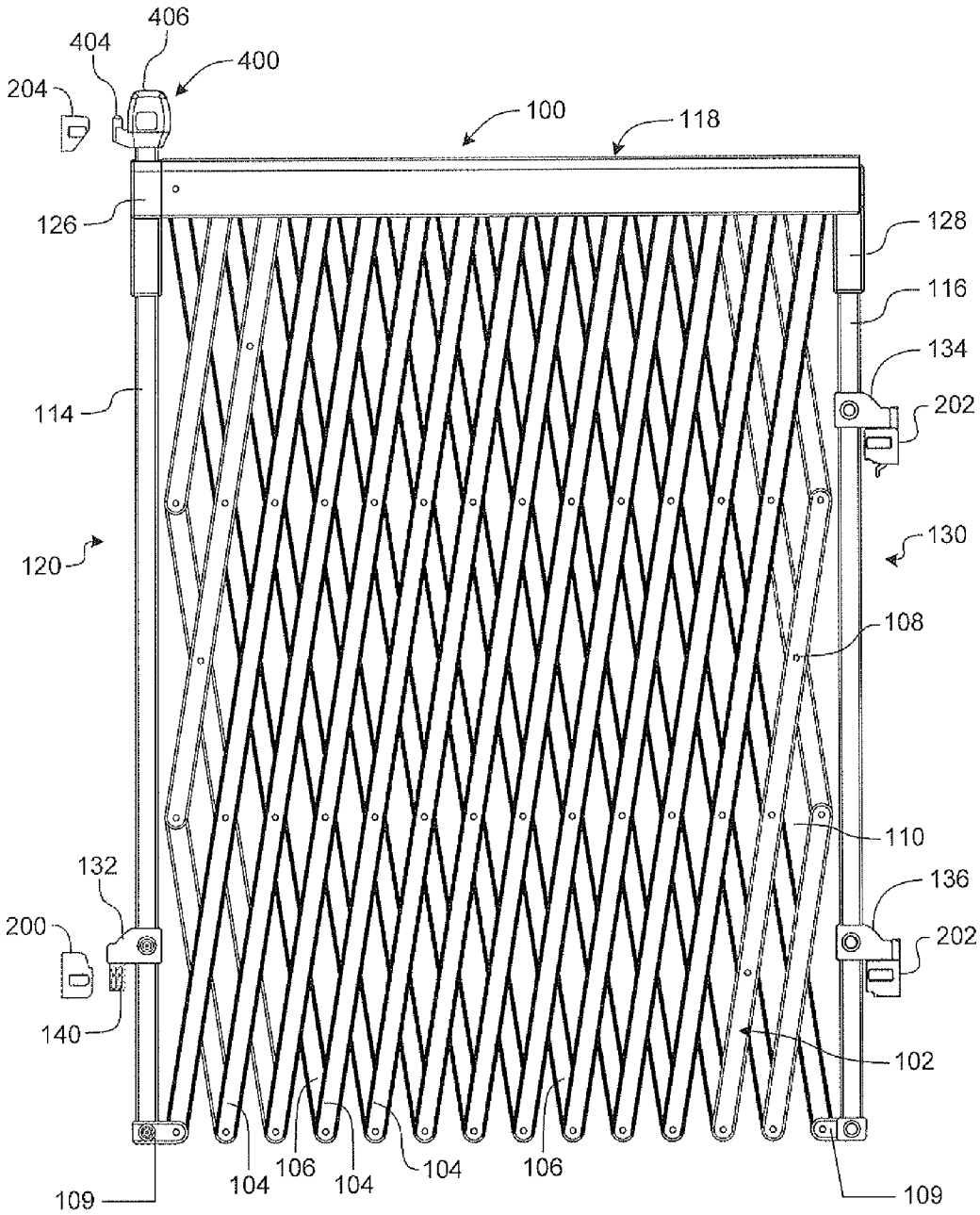
FIG. 19 is a front elevational view of the a gate system having an alternative construction of a handle-lock module in which the gate system is shown in a retracted position and unlocked state.
Figure 20:
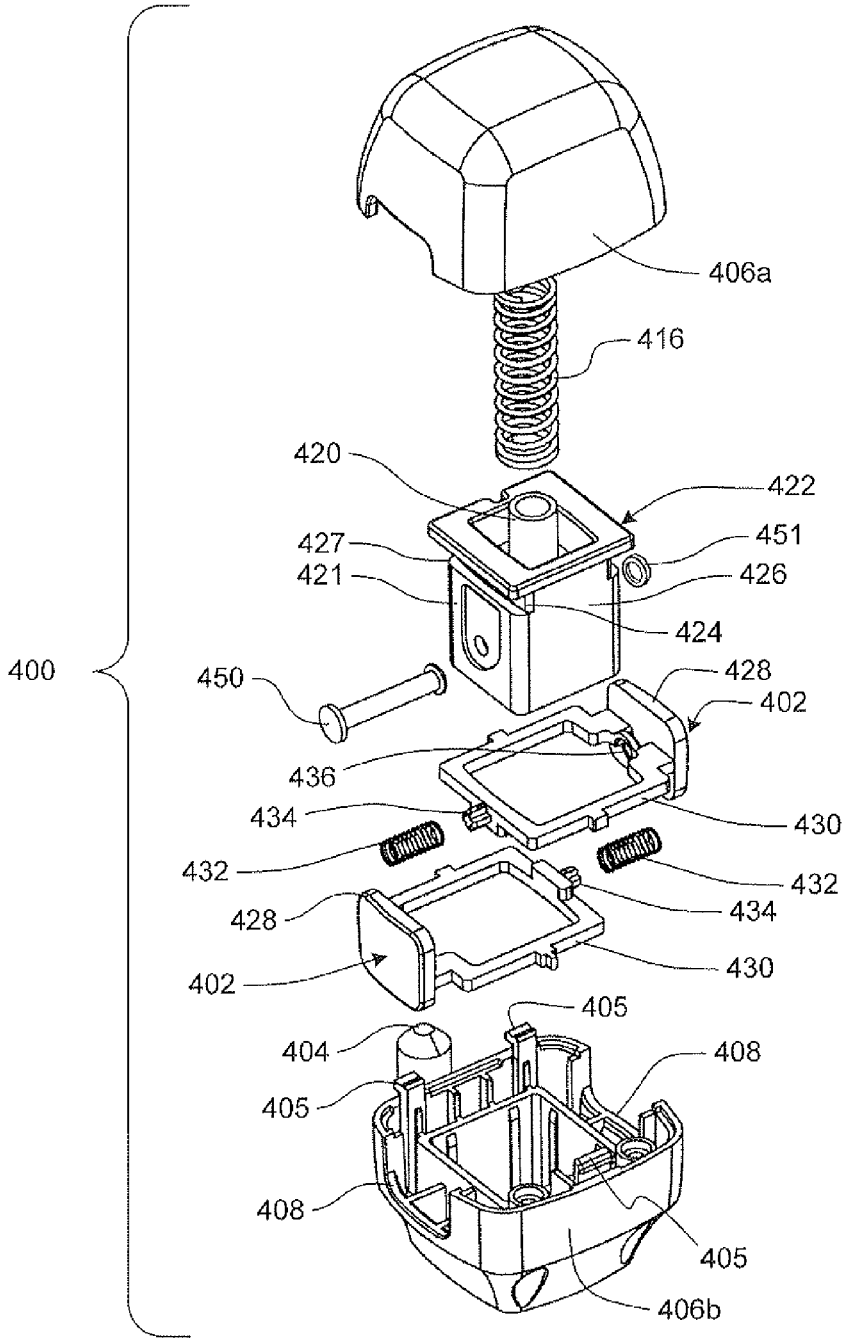
FIG. 20 is an exploded assembly view of the alternative construction of the handle-lock module shown in FIG. 19.

FIGS. 19-26 illustrate an alternative construction of an adjustable width barrier system or gate system, including a gate 100 operable to mechanically cooperate with wall mounts 200, 202, 204 to prevent movement of an object (such as, but not limited to, a child or a pet for example) through a passageway/walkway opening. In particular, an alternative construction of a handle-lock module 400 can be used in lieu of handle-lock module 300 for gate 100. Handle-lock module 400 includes a handle body 406 having the upwardly extending locking pin 404. Referring to FIGS. 19 and 20 in the depicted construction, the handle body 406 is a bulbous hollow shell configured to house components of handle-lock module 400. The handle body 406 is constructed of two shell halves—an upper handle body 406*a* and a lower handle body 406*b* which in the assembled configuration are securely fastened together by tabs 405 extending from lower handle body 406*b*. The outer surface of the handle body 406 may have a tapered arrangement to enable ease of holding the handle-lock module 400 in a hand of a user. The locking pin 404 can have any suitable cross-section to provide the locking function. In the depicted construction, the locking pin 404 has a circular cross-section. The handle body 406 includes two laterally disposed openings 408 to enable slidable movement of the compressible lock control members 402 towards each other or away from each other. The two lateral lock control members 402 are provided in the handle body 406 so that the lock control members 402 enable the unlocking of the gate 100 from its locked state or locking of the gate 100 from its unlocked state. The handle body 406 can be of a molded plastic construction, for example of acrylonitrile butadiene styrene (ABS) plastic or nylon.

Figure 21:
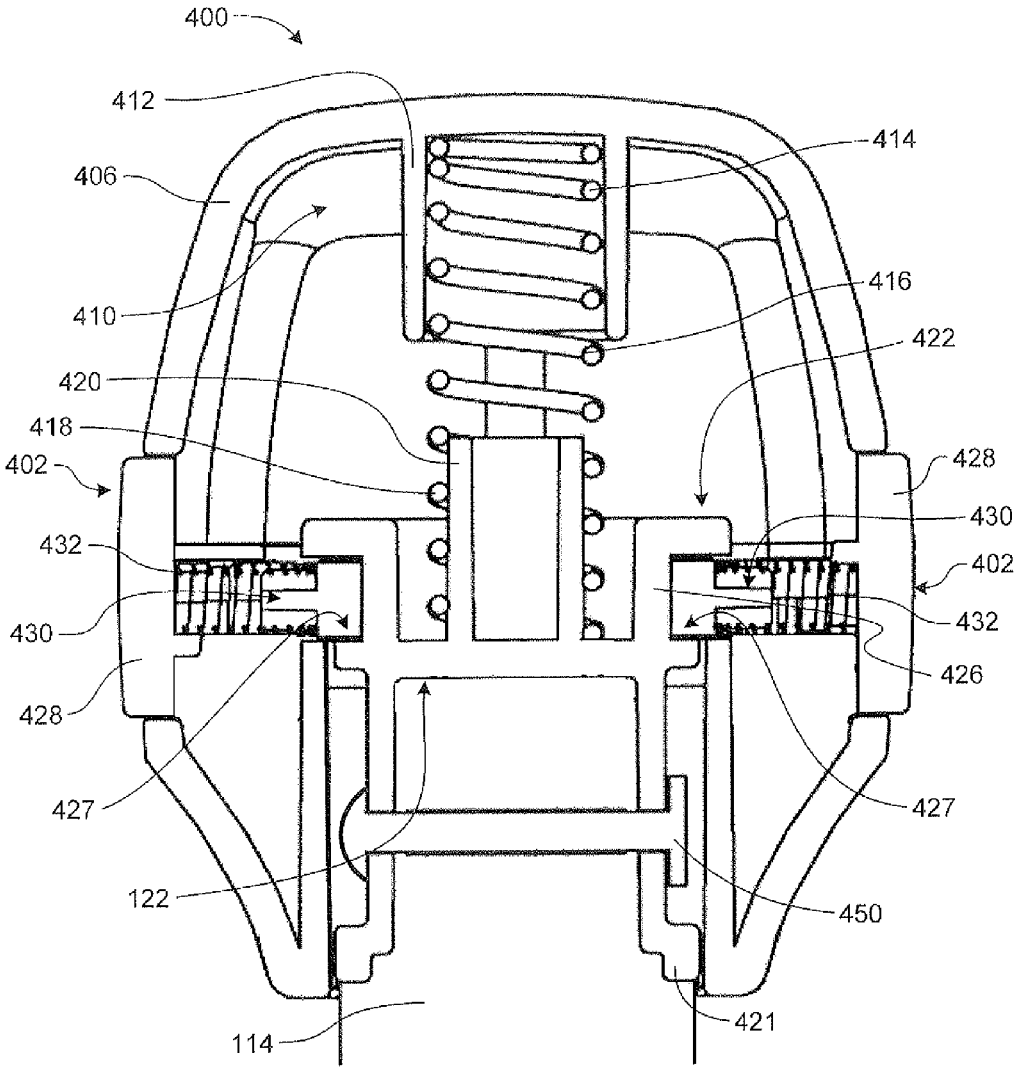
FIG. 21 is an enlarged side cross-sectional view of the alternative construction of the assembled configuration of the handle-lock module shown in FIG. 20 with the handle-lock module in a locked position.
Figure 22:
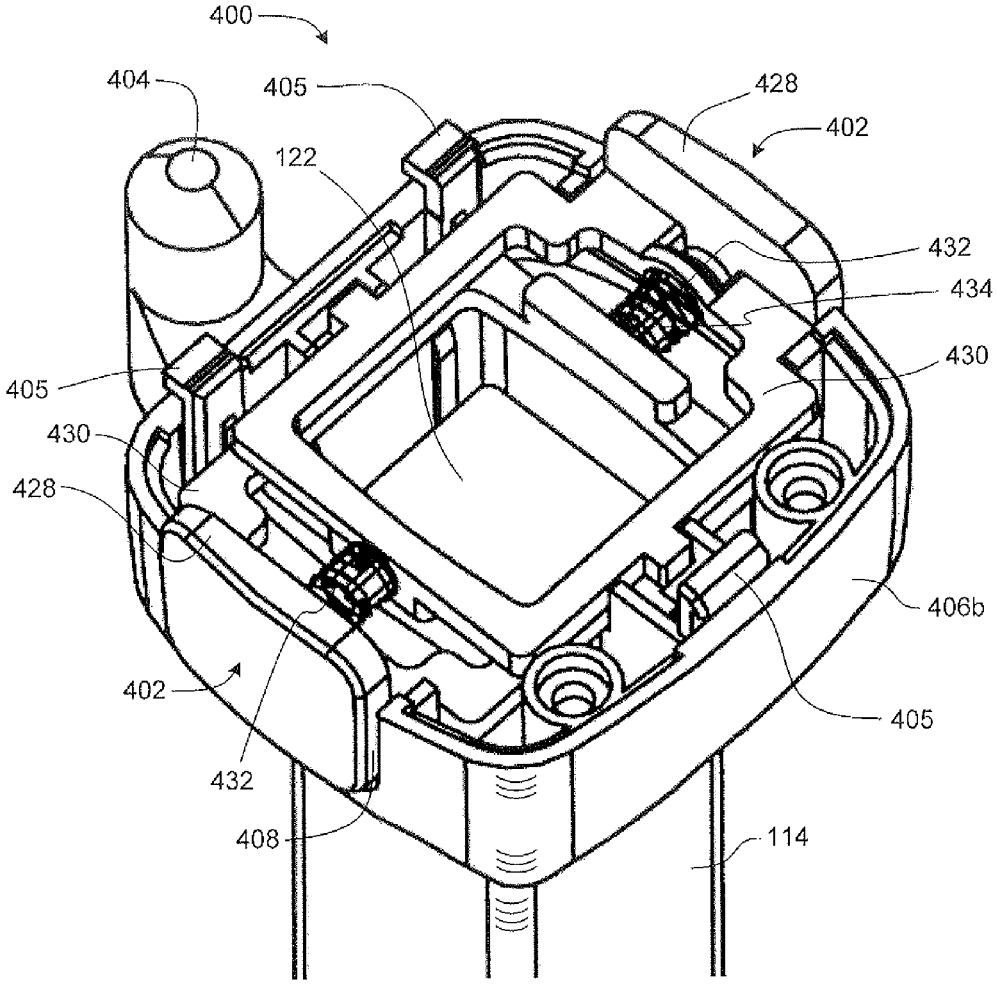
FIG. 22 is an enlarged perspective view of the alternative construction of the assembled configuration of the handle-lock module shown in FIG. 20 with the upper handle body removed to reveal the construction and the positional relationship of finger-engagable buttons within the handle-lock module in a locked position.

Referring to FIG. 21, within the cavity 410 of the handle body 406, the upper inner wall includes a downwardly extending tubular protrusion 412 configured to retain an upper end 414 of a biasing member 416. In the depicted construction, the biasing member 416 is constructed from a helical coil spring. The coil spring may be constructed from a metal material wire and tuned to a desired spring constant. The upper end 414 of the biasing member 416 may be pressure-fit into the inner surface of the tubular protrusion 412. The lower end 418 of the biasing member 416 is disposed pressure-fitted on the outer surface of an upright tubular protrusion 420 of a coupling 422. This arrangement is intended to keep the biasing member 416 in an upright position during linear movement of the handle-lock module 400. The coupling 422 is fixedly attached to the top end 122 of the first vertical end post 114. The fixed attachment can be via any number of ways including adhesive bonding or mechanical fastening, such as a mechanical fastener, screw, bolt or pin 450 mounted laterally to extend through first vertical end post 114 and sidewalls 421 of coupling 422. The mechanical fastener 450 is securely held in place by way of a lock nut or lock washer 451. The lateral mounting of the mechanical fastener 450 provides for increased tensile strength when handle-lock module 400 is lifted upward by a user to prevent separation of the coupling 422 from the first vertical end post 114. As best seen in FIG. 20, coupling 422 has two small ledges 424 laterally disposed on opposing sides of the coupling 422. Each of the ledges 424 is disposed between the coupling outer surface 426 and the outer edge 427. The lock control members 402 and coupling 422 can be of a molded plastic construction, of ABS or nylon, for example.

Figure 23:
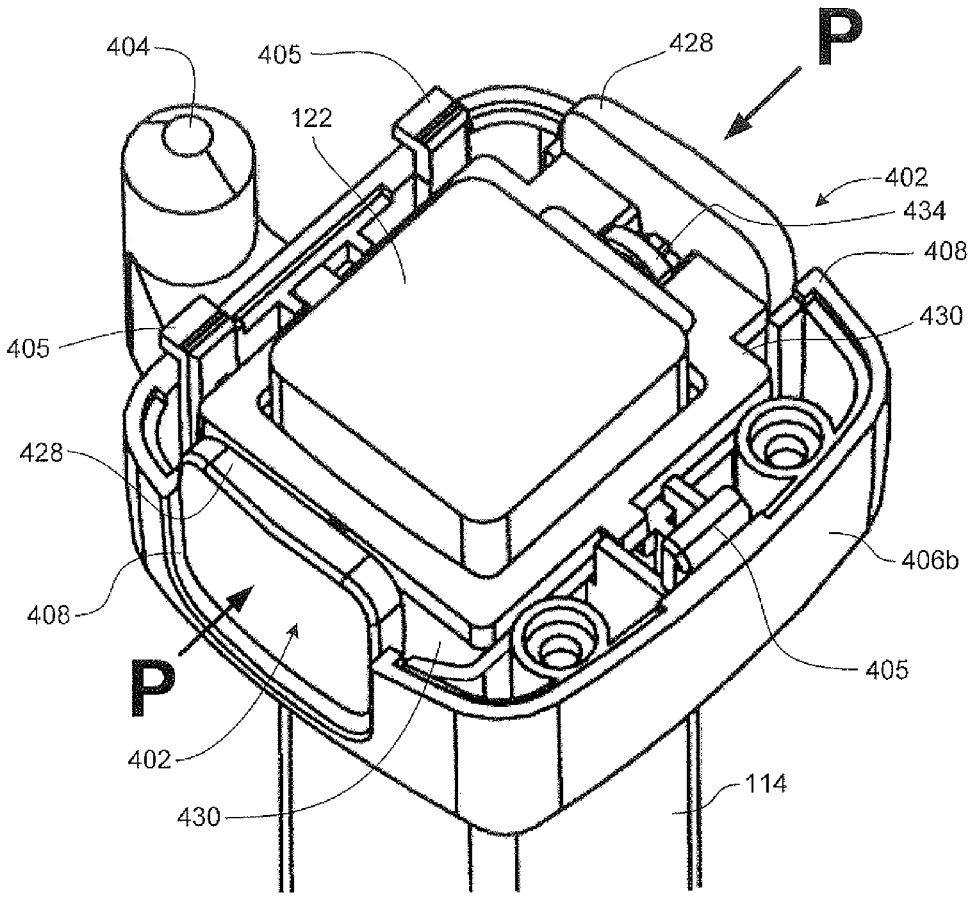
FIG. 23 is an enlarged perspective view of the handle-lock module as shown in FIG. 22 in an unlocked position.

Referring to FIGS. 20 and 21, each of the lock control members 402 is provided with an exposed button member 428 coupled to an open rectangular frame member 430, which is mechanically coupled to a resiliently biased member 432, such as a helical coil spring. Referring to FIG. 20, the frame member 430 includes a nub 434 extending away and the interior side of button member 428 includes a circular retaining cavity 436. In this configuration, one end of the coil spring 432 is pressure-fitted over the nub 434 and the opposing end of the coil spring 432 is retained inside of the retaining cavity 436. In the depicted construction, the nub 434 has a cross or "X"-shape. Nevertheless, other shapes of the nub 434 are possible for the intended mechanical fastening function. The lock control members 402 are resiliently biased to extend away from each other, such that the coil springs 432 are designed to resist movement during a compression force "P" of the button members 428 towards each other in opening 408. (See FIG. 25) As shown in FIG. 23, the top end 122 of the first vertical end post 114 is enabled to pass through the open area of the frame members 430. This pass-through movement occurs during the downward movement of handle-lock module 400 in the course of an unlocking operation.

Figure 24:
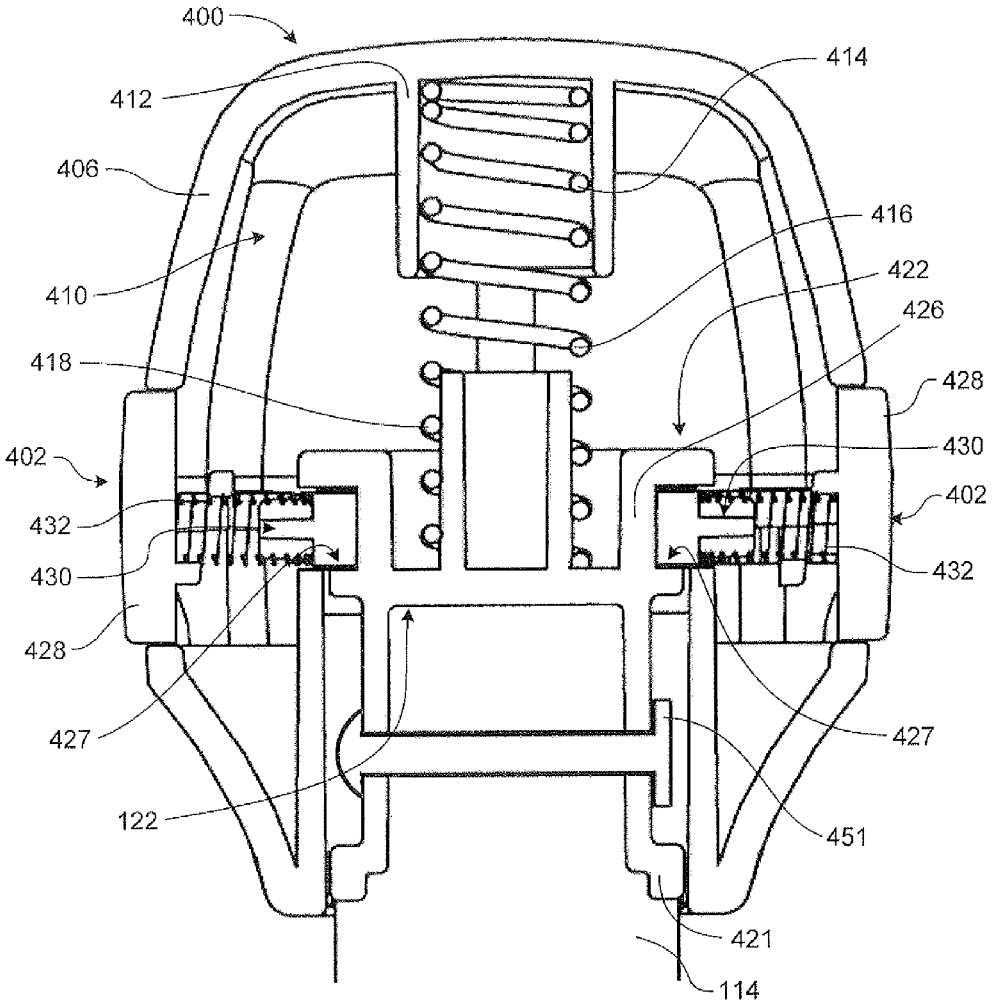
FIG. 24 is an enlarged side cross-sectional view of the assembled configuration of the handle-lock module shown in FIG. 20 with the handle-lock module in a locked position.
Figure 25:
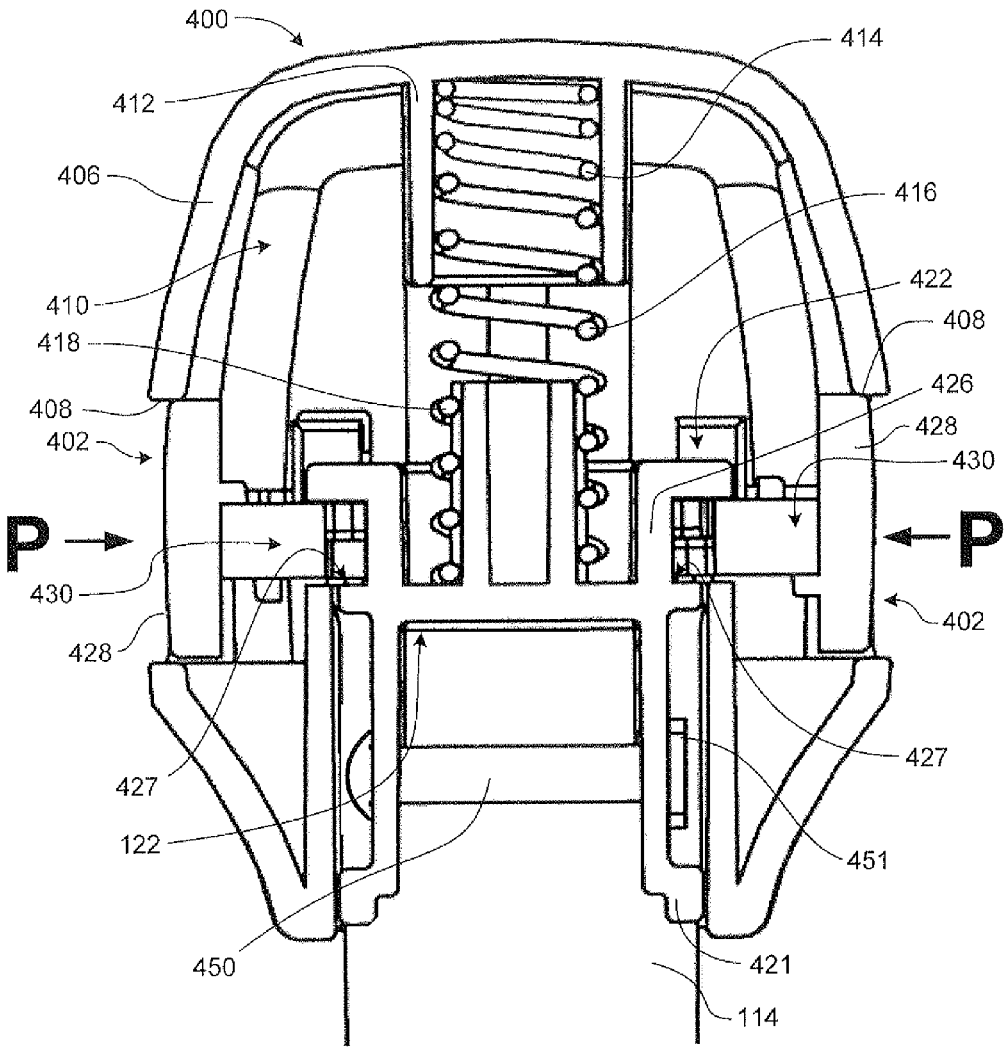
FIG. 25 is an enlarged side cross-sectional view of the assembled configuration of the handle-lock module shown in FIG. 20 with the handle-lock module in an initial unlocked position showing compression of finger-engagable buttons.
Figure 26:
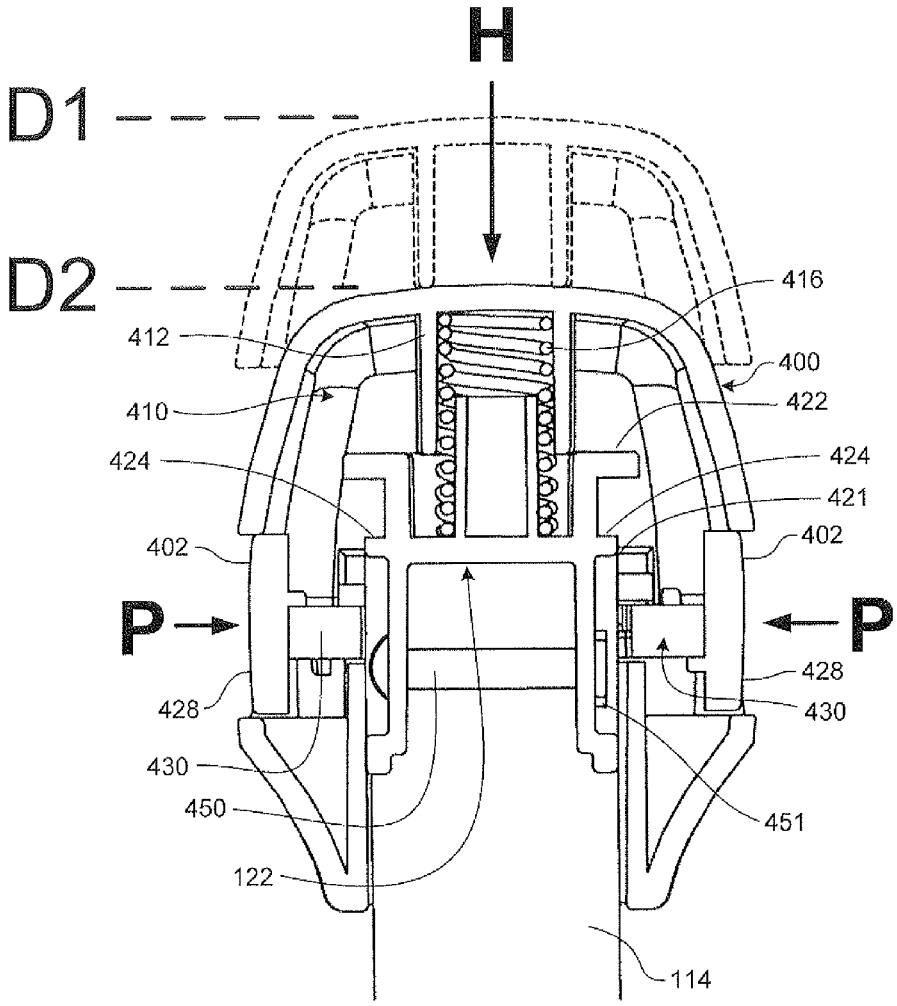
FIG. 26 is an enlarged side cross-sectional view of the assembled configuration of the handle-lock module shown in FIG. 20 with the handle-lock module in an unlocked position showing movement of the finger-engagable buttons and a positional relationship of the handle-lock module along a length of a vertical end post.

Referring to FIGS. 24-26, when the handle-lock module 400 is in the locked state, the biasing member 416 has pushed the handle-lock module 400 upwardly in a locking position. Each of the two laterally disposed lock control members 402 has a portion of the frame member 430 resting on the ledge 424 of coupling 422. This configuration stops downward movement of the handle-lock module 400 until the user applies a lateral compressive pressure "P" to the lock control members 402 to release the handle-lock module 400 from the locked position.

To unlock the gate 100, the user depresses the two lock control members 402 towards each other with compressive pressure "P" as shown in FIG. 25. This depression or compression action slides a portion of the frame member 430 away from the ledge 424 of the coupling 422 such that the handle body 406 is released to slide along a length of the first vertical end post 114. As can be understood from the FIG. 25, each of the frame members 430 is slidably disposed to each other by way of the overlapping arrangement. As shown in FIG. 26, when frame member 430 is released from the ledge 424, the user may then push downwardly on the handle body 406 from vertical position D1.

Further downward force "H" on the handle body 406, pushes it downwardly along sidewall 421 of coupling 422 on the vertical end post 114; as a result, the biasing member 416 becomes compressed due to the downward force H overcoming the opposing biasing force. Furthermore, the top end 122 of the first vertical end post 114 passes through the open area of the frame members 430 to vertical position D2. As can be understood in FIG. 26, distal end of protrusion 412 and the top of coupling 422 abut at the lowest point of the downward movement of handle-lock module 400. In this way, the abutting interaction of the protrusion 412 and coupling 422 provides for a built-in stop feature of the handle-lock module 400. While not shown in FIG. 26, the locking pin 404 will eventually become free from the locking cavity 206 of the lock wall-mount bracket 204.

As can be readily understood by one of skill in art from FIG. 26, to place the gate 100 in the locked state, the biasing member 416 moves the handle body 406 upwardly along the coupling sidewall 421 mounted on the first vertical end post 114 from vertical position D2. During this upward movement, the inner surfaces of the frame members 430 slide along the coupling surface until they reach the top end 122. This feature provides for reduced frictional movement and smooth mechanical interaction of the abutting surfaces of the frame members 430 and coupling sidewall 421. The coil spring 432 on each of the frame members 430 biasedly engages the frame members 430 to laterally slide onto the ledge 424 of the coupling 422. Consequently, the frame members 430 slide into position in handle body 406 onto the ledge 424 where the handle-lock module 400 is placed in its rested locked position at vertical position D1.

Gates embodying the features disclosed herein can be provided in a myriad of dimensional heights and widths for the intended use. In different constructions, the gate 100 can be provided in an appropriate height as desired by the user. The width of gate 100 may range between 24 inches to 72 inches as measured from the gate end 120 to gate end 130. The height of gate 100 may range between 26 inches to 40 inches as measured from the bottom of the first vertical rail 114 to the top of adjustable length horizontal rail 118.

In one construction, the handle-lock module 300 or module 400 is elevated above the horizontal rail 118 to an ergonomic height. This configuration reduces potential musculoskeletal pain in a user's lumbar section or legs. That is, the user does not need to crouch or bend down to unlock the gate 100. This ergonomic feature is advantageous, when considering a user may be holding a small child or pet (for example) in one hand and can proceed to unlock the gate with the other hand without bending or crouching down. Furthermore, this configuration of horizontal rail 118 assists in preventing small children or small pets (for example) from reaching the handle-lock module 300 or handle-lock module 400 to unlock the gate 100. The principles taught herein can be employed in a wide variety of configurations.

The use of the terms first or second when designating features is non-limited in scope in that the terms are used for ease of explanation. While the present invention has been described with reference to exemplary embodiments, it will be understood by those of ordinary skill in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiments disclosed, but that the invention will include all embodiments falling within the scope of the appended claims.

What is claimed is:

1. A gate, comprising:

an expandable barrier having a top end, a bottom end, and a horizontal rail forming an uppermost surface of the barrier, the horizontal rail having an uppermost top horizontal edge;

a first and second vertical end post, wherein the top end of the expandable barrier is adjacent to a top end of the first vertical end post and the bottom end of the expandable barrier is adjacent to a bottom end of the first vertical end post; and an entire handle-lock module including a locking member is located entirely above the uppermost top horizontal edge of the horizontal rail in all operating positions of the gate and biased upwardly for controlling at least one of locking and unlocking the gate.

2. The gate according to claim 1, wherein the locking member is movable with the handle-lock module and is also located above the uppermost top horizontal edge of the horizontal rail.

3. The gate according to claim 2, wherein the horizontal rail is an adjustable length horizontal rail; wherein the handle-lock module further having a biasing member for urging the handle-lock module to a locking position, and the handle-lock module being located above the adjustable length horizontal rail.

4. The gate according to claim 3, wherein the locking member further comprises an upwardly extending protrusion.

5. The gate according to claim 3, wherein the handle-lock module further includes laterally mounted finger-engageable buttons provided on opposing sides of the handle-locking module and configured for simultaneous depression to control the unlocking operation of the gate.

6. The gate according to claim 5, wherein the laterally mounted finger-engageable buttons are nested within the handle-lock module.

7. The gate according to claim 6, wherein each of the finger-engageable buttons includes an integrally molded spring member, each spring member being configured to bias the finger-engageable button of another lock control member in an outward direction from each other.

8. The gate according to claim 3, wherein the first vertical end post is coupled to the expandable barrier at one lateral end and has a portion extending above the adjustable length horizontal rail; and wherein the handle-lock module is slidably movable vertically along a length of the first vertical end post.

9. The gate according to claim 8, wherein the handle-lock module includes an opening configured to receive a portion of the first vertical end post therein.

10. The gate according to claim 8, wherein the biasing member is coupled to the top of the first vertical end post and coupled to the handle-lock module.

11. The gate according to claim 8, wherein the handle-lock module further comprises laterally mounted finger-engageable elements provided on opposing sides of the handle-lock module, wherein the handle-lock module and included finger-engageable elements are vertically movable relative to a top end of the first vertical end post when the finger-engageable elements are depressed; and wherein at least one of the finger-engageable elements includes a spring member.

12. The gate according to claim 3, wherein a bottom of the handle-lock module is located at least 1.0 inch above the expandable barrier.

13. The gate according to claim 12, wherein the handle-lock module is configured to vertically travel at least ½ inch to affect the locking and unlocking of the gate.

14. The gate according to claim 3, further including a pin disposed one side of the expandable barrier, the pin including an extension leg being biased to provide a snap-fit engagement with a wall mount.

15. The gate according to claim 14, wherein the extension leg of the mounting pin includes a tab at a distal end enabling the extension leg to be released from the wall mount.

16. The gate according to claim 3, wherein at least one of the first or second vertical end posts is disposed at a lateral end of the expandable barrier; wherein the adjustable length horizontal rail is slidably coupled to the first vertical end post to vertically slide along a length of the first vertical end post during an expansion or a retraction of the expandable barrier.

17. The gate according to claim 16, further comprising a tubular coupling member for providing the slidable coupling to the post.

18. The gate according to claim 16, wherein a vertical distance between the handle-lock module and the adjustable length horizontal rail changes during an expansion or retraction of the expandable barrier.

19. A gate comprising:

an expandable barrier with a horizontal rail forming an uppermost surface of the barrier, the barrier having a top end, a bottom end, a first end and a second end;

a downwardly extending docking pin disposed at the first end of the barrier;

a first vertical rail provided at the first end of the barrier and a second vertical rail provided at the second end of the barrier, wherein the top end of the expandable barrier is adjacent to a top end of the first vertical rail and the bottom end of the expandable barrier is adjacent to a bottom end of the first vertical rail; and an upwardly extending locking pin included as part of a handle-lock body, the handle-lock body disposed over the horizontal rail at all operating positions of the gate, and being coaxially aligned with a center axis of the first vertical rail, the upwardly extending locking pin being located above and coaxial with the downwardly extending docking pin, wherein the locking pin is biased in a direction away from the docking pin to maintain the gate in a locked state.

20. The gate according to claim 19, wherein the locking pin and the docking pin each have a circular cross-section.

21. The gate according to claim 19, wherein the second end includes two vertically spaced, downwardly extending hinge pins.

22. The gate according to claim 21, wherein the hinge pins on the second end are circular in cross-section.

23. The gate according to claim 21, wherein at least one of the hinge pins on the second end is configured for snap-fit engagement with a mount and includes an extension leg being biased to provide a snap-fit engagement with the mount, the extension leg including a tab at a distal end enabling the extension leg to be released from the mount.

24. A gate, comprising:

an expandable barrier, the expandable barrier having a horizontal rail;

a first and second vertical rail; and a gate-lock having a housing and a recess which receives a top end of the first vertical rail, said housing and recess being telescopically coupled to the first vertical rail for relative movement to control at least one of locking and unlocking of the gate; wherein the gate-lock is movable between locked and unlocked positions, such that a locking member of said gate-lock moves substantially parallel relative to the first vertical rail in order to lock and unlock the gate.

25. The gate according to claim 24, wherein the horizontal rail is an adjustable length horizontal rail.

26. The gate according to claim 25, wherein a bottom of the gate-lock is located at least 1.0 inch above the adjustable length horizontal rail when the gate-lock is in its locked position.

27. The gate according to claim 25, wherein a top portion of the gate-lock is located 6.0 inches above the adjustable length horizontal rail.

28. The gate according to claim 25, wherein the gate-lock has a vertical range of travel of 3 inches.

29. The gate according to claim 24, further comprising a biasing device for urging the gate-lock in an upward direction to extend the gate-lock further along the first vertical rail, and away from the horizontal rail.

* * * * *